US008986915B2

(12) United States Patent
Kabai et al.

(10) Patent No.: US 8,986,915 B2
(45) **Date of Patent: *Mar. 24, 2015**

(54) TONER, METHOD FOR PRODUCING THE SAME, CARTRIDGE STORING THE SAME, PROCESS CARTRIDGE, AND IMAGE FORMING APPARATUS

(75) Inventors: Takahito Kabai, Shizuoka-ken (JP); Tsuyoshi Itou, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 24 days.

This patent is subject to a terminal disclaimer.

(21) Appl. No.: 13/548,296

(22) Filed: Jul. 13, 2012

(65) Prior Publication Data

US 2012/0282545 A1 Nov. 8, 2012

Related U.S. Application Data

(63) Continuation-in-part of application No. 12/704,075, filed on Feb. 11, 2010, now Pat. No. 8,252,496.

(51) Int. Cl.

| | |
|---|---|
| ***G03G 9/00*** | (2006.01) |
| ***G03G 9/08*** | (2006.01) |
| ***G03G 9/09*** | (2006.01) |
| ***G03G 9/093*** | (2006.01) |

(52) U.S. Cl.

CPC ..... *G03G 9/0806* (2013.01); *G03G 9/0815* (2013.01); *G03G 9/0825* (2013.01); *G03G 9/0926* (2013.01); *G03G 9/0928* (2013.01); *G03G 9/0804* (2013.01); *G03G 9/0819* (2013.01); *G03G 9/093* (2013.01)

USPC ..... 430/110.2; 430/137.1; 430/137.14

(58) Field of Classification Search

CPC ... G03G 9/0804; G03G 9/0808; G03G 9/093; G03G 9/0935; G03G 9/09321; G03G 15/0832

USPC ..... 430/110.2, 137.1, 137.14; 399/111

See application file for complete search history.

(56) References Cited

U.S. PATENT DOCUMENTS

| | | | |
|---|---|---|---|
| 4,720,301 | A | 1/1988 | Kito et al. |
| 4,732,810 | A | 3/1988 | Kito et al. |
| 4,865,648 | A | 9/1989 | Kito et al. |
| 7,354,885 | B2 | 4/2008 | Takayama et al. |

(Continued)

FOREIGN PATENT DOCUMENTS

| | | | |
|---|---|---|---|
| EP | 0980028 | A1 | 2/2000 |
| EP | 1477320 | A2 | 11/2004 |

(Continued)

OTHER PUBLICATIONS

European Search Report dated Sep. 14, 2010 for European Application No. 10153576.3, 6 pages.

(Continued)

*Primary Examiner* — Thorl Chea

(74) *Attorney, Agent, or Firm* — Amin, Turocy & Watson, LLP

(57) ABSTRACT

According to one embodiment, a toner includes at least one encapsulated particle containing a color developable compound, color developer and a color eraser and polymeric particles. The at least one encapsulated particle and the polymeric particles being aggregated and fused in dispersion liquid.

10 Claims, 9 Drawing Sheets

(56) References Cited

U.S. PATENT DOCUMENTS

| | | | | |
|---|---|---|---|---|
| 7,569,515 | B2 | 8/2009 | Takayama et al. | |
| 7,608,378 | B2 | 10/2009 | Urabe et al. | |
| 8,252,496 | B2 * | 8/2012 | Kabai et al. | 430/110.2 |
| 8,557,495 | B2 | 10/2013 | Kabai et al. | |
| 2004/0229754 | A1 | 11/2004 | Fujita | |
| 2005/0250037 | A1 * | 11/2005 | Sawada et al. | 430/109.4 |
| 2007/0231723 | A1 | 10/2007 | Kimura et al. | |
| 2008/0171282 | A1 | 7/2008 | Urabe et al. | |
| 2009/0050013 | A1 | 2/2009 | Fujita | |
| 2010/0209839 | A1 * | 8/2010 | Kabai et al. | 430/110.2 |

FOREIGN PATENT DOCUMENTS

| | | | |
|---|---|---|---|
| EP | 1902852 | A1 | 3/2008 |
| EP | 2138550 | | 12/2009 |
| JP | 06-161153 | | 6/1994 |
| JP | 10-293413 | | 11/1998 |
| JP | 2000-330321 | | 11/2000 |
| JP | 2003221405 | A | 8/2003 |
| JP | 2007094070 | | 4/2007 |
| JP | 2009-300991 | | 12/2009 |

OTHER PUBLICATIONS

Korean Office Action for Application No. 10-2010-13174, mailed on Sep. 1, 2011, 10 pages.

Office Action dated Dec. 9, 2011 for U.S. Appl. No. 12/704,075, 15 pages.

Office Action dated Jan. 31, 2013 for U.S. Appl. No. 13/552,773, 13 pages.

Japanese Office Action for Japanese Patent Application No. 2010-031798 mailed on Nov. 26, 2013.

U.S. Office Action for U.S. Appl. No. 14/010,873 mailed on Jun. 19, 2014, 23 pages.

First Office Action for Japanese Patent Application No. 2014-050626 Dated Jan. 6, 2015, 4 pages.

* cited by examiner

TONER, METHOD FOR PRODUCING THE SAME, CARTRIDGE STORING THE SAME, PROCESS CARTRIDGE, AND IMAGE FORMING APPARATUS

CROSS-REFERENCE TO THE RELATED APPLICATIONS

This is a Continuation in part Application of U.S. patent application Ser. No. 12/704,075, filed on Feb. 11, 2010, the entire contents of which are incorporated herein by reference.

This application is based upon and claims the benefit of priority from U.S. Provisional Application No. 61/152,798, filed on Feb. 16, 2009, the entire contents of which are incorporated herein by reference.

FIELD

Embodiments described herein relate generally to an electrophotographic toner and a method for producing the same, cartridge storing the same, process cartridge and image forming apparatus.

BACKGROUND

A method of recycling a recording medium such as paper by erasing the color of a toner image formed on the recording medium such as paper is very effective from the viewpoint of environmental protection and economic efficiency due to reduction in the using amount of a recording medium such as paper.

As an erasable toner, for example, as proposed in Japanese Patent No. 4105718, a toner which contains a color developable compound and a color developer and the color of which can be erased by heating is known. In this technique, the color developable compound and the color developer are melt-kneaded together with a binder resin by a kneading pulverization method, and the resulting melt-kneaded material is incorporated in the inside of a toner. With the use of this toner, by heating a sheet of printed paper to 100 to 200° C. for about 1 to 3 hours, the color of the printed image can be erased, and further, the paper on which the color of the printed image was erased can be recycled. This technique is an excellent technique capable of contributing to a decrease in environmental load by reducing consumption of paper.

However, when a kneading pulverization method is used, kneading is performed at a high temperature between about 100 and 200° C. under a high shearing force. Therefore, a leuco dye (the color developable compound) and the color developer are uniformly dispersed in the binder resin and a reaction between the leuco dye and the color developer is inhibited to decrease the developed color density of the toner. Further, if a toner material such as a binder resin or a release agent has a color erasing action, the developed color density of the toner is decreased during kneading in the same manner. Therefore, it is necessary to select toner materials with a low color erasing action. In particular, as a binder resin, only a specific resin with no color erasing action such as a styrene-butadiene resin is allowed to be used, and it is very difficult to use a polyester resin or a styrene-acrylic resin which is excellent in fixability because such a resin is liable to exhibit a color erasing action.

Accordingly, a toner which can satisfy all of the properties: fixability, color developability, and erasability was not obtained yet.

DETAILED DESCRIPTION

Hereinafter, the embodiment is described in more detail with reference to the drawings.

Figure 1:
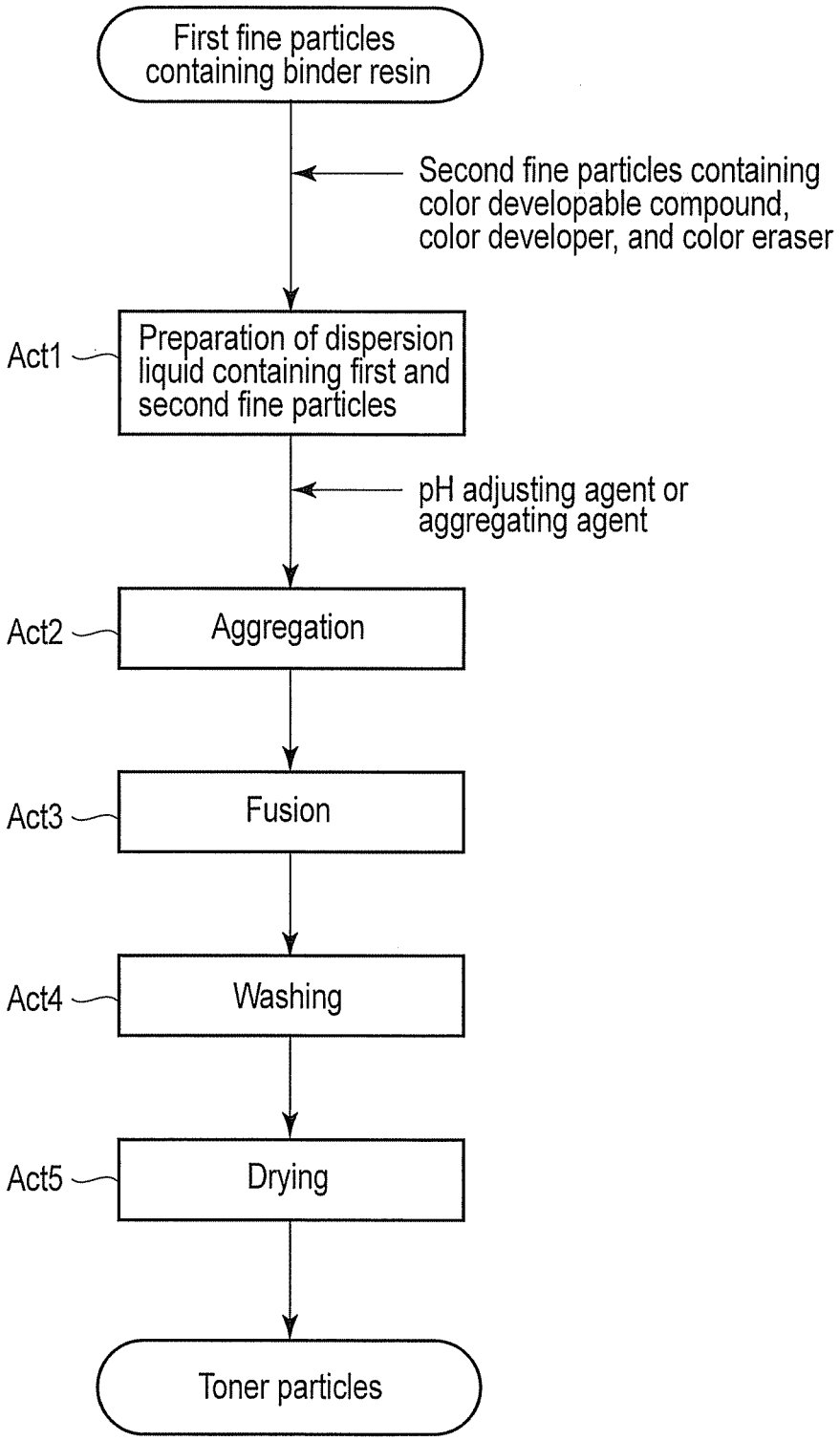
FIG. 1 is a flowchart showing a method for producing a toner according to one embodiment of the invention.

FIG. 1 is a flowchart showing a method for producing a toner according to one embodiment of the invention.

As shown in FIG. 1, in the method for producing a toner according to a first embodiment, first of all, first fine particles containing at least a binder resin and second fine particles containing a color developable compound, a color developer, and a color eraser are separately prepared, and a dispersion liquid containing the first fine particles and the second fine particles is prepared (Act 1). Then, the first and second fine particles contained in the dispersion liquid are aggregated to form aggregated particles (Act 2). Thereafter, for example, the aggregated particles are fused by heating (Act 3), the resulting fused particles are washed (Act 4) and dried (Act 5), whereby toner particles can be formed.

To the surfaces of the toner particles, an additive such as inorganic fine particles can be applied as needed.

The first fine particles preferably have a volume average particle diameter of from 0.01 to 2.0 μm.

When the volume average particle diameter thereof is less than 0.01 μm, the amount of an aggregating agent is increased and the chargeability or fixability tends to be deteriorated. Meanwhile, when the volume average particle diameter thereof exceeds 2.0 μm, the particle diameter of the resulting toner is increased and the quality of an image tends to be deteriorated.

The second fine particles preferably have a volume average particle diameter of from 0.05 to 10.0 μm.

When the volume average particle diameter thereof is less than 0.05 μm, the developed color density is decreased and the density of an image tends to be decreased. Meanwhile, when the volume average particle diameter thereof exceeds 10.0 μm, the particle diameter of the resulting toner is increased and the quality of an image tends to be deteriorated.

Figure 2:
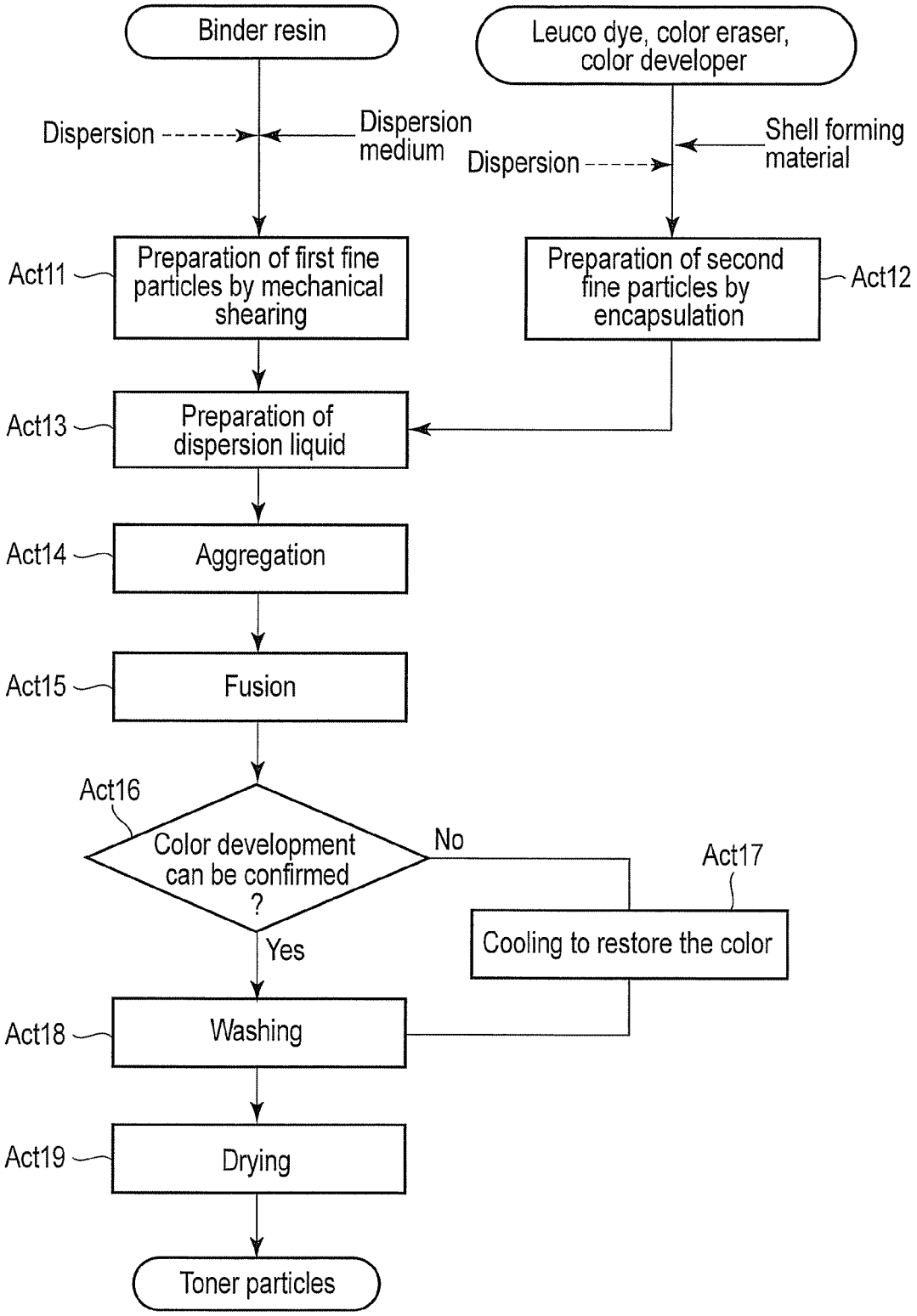
FIG. 2 is a flowchart showing a method for producing a toner according to another embodiment of the invention.

FIG. 2 is a flowchart showing a method for producing a toner according to another embodiment.

First fine particles can be formed by, for example, subjecting a dispersion liquid of resin particles containing at least a binder resin to mechanical shearing to pulverize the resin particles into fine particles such that the resulting fine particles have a particle diameter smaller than that of the resin particles (Act 1).

Second fine particles are formed by encapsulating a core component containing a color developable compound, a color developer, and color eraser with a shell component which encapsulates the core component (Act 12).

As the color developable compound, for example, a leuco dye, the color of which is erased when it is heated to a temperature not lower than the color erasing temperature thereof and is developed when it is cooled to a temperature not higher than the color restoring temperature thereof can be used as a representative material.

A dispersion liquid containing the first fine particles, the second fine particles, and an aqueous medium is prepared (Act 13).

The first and second fine particles are aggregated (Act 14).

The resulting aggregated particles are further fused by heating (Act 15).

It is confirmed whether or not the color of the leuco dye in the fused particles is developed (Act 16). When the color of the leuco dye is not developed, the particles are cooled to the color restoring temperature thereof (Act 17).

The resulting fused particles are washed (Act 18) and dried (Act 19), whereby toner particles can be formed.

The fusion by heating can be performed at a temperature in a range of, for example, from 40 to 95° C.

A binder resin, a release agent, and the like can be selected such that the fusion can be performed within this temperature range.

By using the method for producing a toner according to the embodiment, unlike the case of using melt-kneading, the leuco dye and the color developer are not too uniformly dispersed in the binder resin, therefore, a reaction between the leuco dye and the color developer is not inhibited, whereby a toner can be produced without decreasing the developed color density.

In addition, even if a binder resin, a release agent, or the like which has a color erasing action is used as a toner material, the developed color density of a toner is not decreased during production, and therefore, it is not necessary to select a toner material having a low color erasing action.

Further, it becomes possible to erase the color more rapidly by encapsulating a core component containing a color developable compound, a color developer, and a color eraser with a shell component.

By forming an image using the toner according to the embodiment, when the color of the leuco dye was erased, the image can be cooled to a temperature at which the color is restored.

The toner according to one embodiment includes toner particles containing at least a binder resin and fine particles which are dispersed in the binder resin and contain a color developable compound. The fine particles are encapsulated fine particles having a core component containing a color developable compound, a color developer, and a color eraser and a shell component which encapsulates the core component.

This toner can be obtained by the method according to FIG. 2, and includes toner particles obtained by preparing a dispersion liquid containing first fine particles containing at least a binder resin, second fine particles obtained by encapsulating a core component containing a color developable compound, a color developer, and a color eraser with a shell component, an aqueous medium, and the like, aggregating the first and second fine particles in the dispersion liquid by, for examples, adjusting the pH of the dispersion liquid to form aggregated particles, followed by fusing the resulting aggregated particles.

Figure 3:
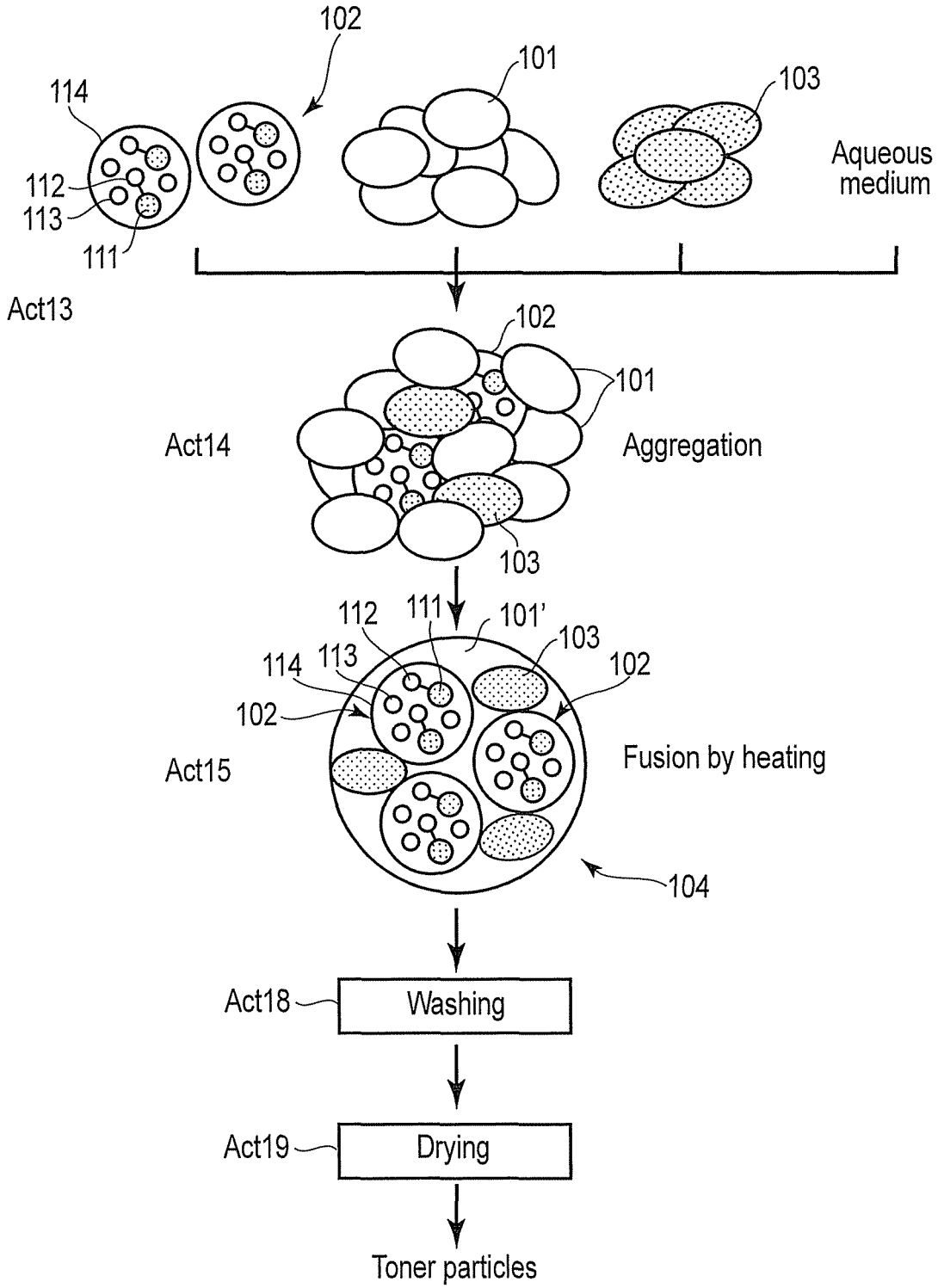
FIG. 3 is a model diagram showing a portion of the above-mentioned method for producing a toner according to another embodiment of the invention.

FIG. 3 is a model diagram showing a portion of the above-mentioned method for producing a toner according to another embodiment.

In FIG. 3, the same symbols: Acts 13, 14, 15, 16, 17, 18, and 19 as in FIG. 2 indicate the same steps.

As shown in the drawing, in the step of preparing a dispersion liquid, first fine particles 101 containing a binder resin, second fine particles 102 obtained by encapsulating a core material containing, for example, a color developable compound III such as a leuco dye, a color developer 112, and a color eraser component 113 with a shell material 114, and an optional component such as wax particles 103 are dispersed in an aqueous medium (Act 13).

Then, the first fine particles 101 containing a binder resin, the encapsulated second fine particles 102 containing a color developable compound such as a leuco dye, and an optional component such as wax particles 103 are aggregated in the aqueous medium (Act 14).

The resulting aggregated particles are fused by heating to obtain toner particles 104 (Act 15).

As shown in the drawing, the toner particles 104 to be used in the toner according to the embodiment has a configuration in which the second fine particles 102 obtained by encapsulating a core material containing a color developable compound 111, a color developer 112, and a color eraser component 113 with a shell material 114, and an optional component of wax particles 103 are dispersed in a binder resin 101' serving as a constituent of the first fine particles.

In the toner particles 104, the color developable compound 111 and the color developer 112 are coupled with each other to develop a color. When the color is to be erased, for example, by coupling the color developer 112 with the color eraser component 113, the coupling of the color developable compound 111 with the color developer 112 can be inhibited.

Figure 4:
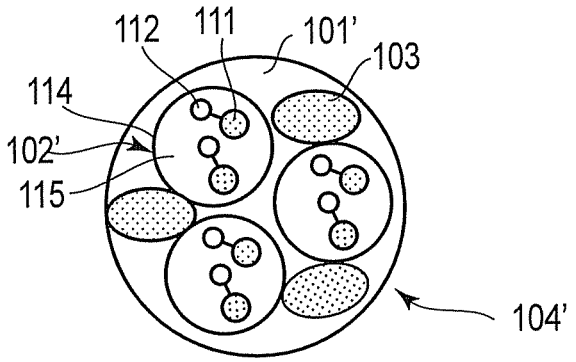
FIG. 4 is a model diagram showing another embodiment of toner particles to be used in a toner of the invention.

FIG. 4 is a model diagram showing another embodiment of the toner particles to be used in the toner according to the embodiment.

The toner particles 104' have a configuration similar to that of the toner particles 104 shown in FIG. 3 except that second fine particles 102' containing a medium 115 having a color erasing action in place of the color eraser component 113 are contained therein.

Thereafter, the toner particles 104 are subjected to washing (Act 18) and drying (Act 19).

Examples of the encapsulation method include an interfacial polymerization method, a coacervation method, an in-situ polymerization method, a submerged drying method, and a submerged curing coating method.

In particular, an in-situ method using a melamin resin as the shell component, an interfacial polymerization method using a urethane resin as the shell component, or the like is preferred.

In the case of an in-situ method, first, the above-mentioned three components are dissolved and mixed, and then, emulsified in a water-soluble polymer or an aqueous solution of a surfactant. Thereafter, an aqueous solution of a melamin-formalin prepolymer is added thereto, and the resulting mixture is subjected to polymerization by heating to achieve encapsulation.

In the case of an interfacial polymerization method, the above-mentioned three components and a polyvalent isocyanate prepolymer are dissolved and mixed, and then, emulsified in a water-soluble polymer or an aqueous solution of a surfactant. Thereafter, a polyvalent base such as a diamine or a diol is added thereto, and the resulting mixture is subjected to polymerization by heating to achieve encapsulation.

Incidentally, the leuco dye, the color developer, and the color eraser can be blended not only in the encapsulated second fine particles, but also in the first fine particles containing a binder resin.

The color developable compound such as a leuco dye, the color developer, and the color eraser to be used in the embodiment are described below.

The leuco dye is an electron donating compound capable of developing a color by coupling with a color developer, and examples thereof include diphenylmethane phthalides, phenylindolyl phthalides, indolyl phthalides, diphenylmethane azaphthalides, phenylindolyl azaphthalides, fluorans, styrynoquinolines, and diaza-Rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino) fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino) fluoran, 1,2-benz-6-(N-ethyl-N-isoamylamino) fluoran, 2-(3-methoxy-4-dodecoxystyryl)quinoline, spiro[5H-(1) benzopyrano(2,3-d)pyrimidine-5,1'(3'H)isobenzofuran]-3'-one, 2-(diethylamino)-8-(diethylamino)-4-methyl-, spiro [5H-(1)benzopyrano(2,3-d)pyrimidine-5,1'(3'H) isobenzofuran]-3'-one, 2-(di-n-butylamino)-8-(di-n-butylamino)-4-methyl-, spiro[5H-(1)benzopyrano(2,3-d) pyrimidine-5,1'(3'H)isobenzofuran]-3'-one, 2-(di-n-butylamino)-8-(diethylamino)-4-methyl-, spiro[5H-(1) benzopyrano(2,3-d)pyrimidine-5,1'(3'H)isobenzofuran]-3'-one, 2-(di-n-butylamino)-8-(N-ethyl-N-1-amylamino)-4-methyl-, spiro[5H-(1)benzopyrano(2,3-d)pyrimidine-5,1' (3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more of them.

The color developer to be used in the embodiment is an electron accepting compound which donates a proton to the color developable compound. The color developer serves as a coupler which is coupled with a color developable compound for accepting electron from the compound and donates proton to the compound to make the compound developed. Therefore, the word "coupler" and the word "developer" is interchangeably used. Examples of the color developer include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole and derivatives thereof. Additional examples thereof include those having, as a substituent, an alkyl group, an aryl group, an acyl group, an alkoxycarbonyl group, a carboxy group and an ester thereof, an amide group, or a halogen group, and bisphenols, trisphenols, phenol-aldehyde condensed resins, and metal salts thereof. These compounds may be used by mixing two or more of them.

Specific examples thereof include phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or esters thereof such as methyl 2,3-dihydroxybenzoate and methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)-n-hexane, 1,1-bis(4-hydroxyphenyl)-n-heptane, 1,1-bis(4-hydroxyphenyl)-n-octane, 1,1-bis(4-hydroxyphenyl)-n-nonane, 1,1-bis(4-hydroxyphenyl)-n-decane, 1,1-bis(4-hydroxyphenyl)-n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl) hexafluoropropane, 2,2-bis(4-hydroxyphenyl)-n-heptane 2,2-bis(4-hydroxyphenyl)-n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl) methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene) bisphenol, and methylenetris-p-cresol.

As the color eraser to be used in the embodiment, a known substance can be used in a system of three components: a color developable compound, a color developer, and a color eraser as long as it is the substance which can change a color into colorless by inhibiting a color developing reaction between the color developable compound such as a leuco dye with the color developer through heating.

For example, as a form of the color eraser, there are 1) a form in which a component obtained by coupling a leuco dye with a color developer to develop a color and a color eraser component are dispersed in a medium having a low color developing and erasing action or without having such an action as shown by fine particles 102; and 2) a form in which a color eraser component is used as a medium for a component obtained by coupling a leuco dye with a color developer to develop a color as shown by fine particles 102'.

The color eraser to be used in the form of 2), particularly, a color developing and erasing mechanism utilizing the thermal hysteresis exhibited by a known color eraser disclosed in JP-A-60-264285, JP-A-2005-1369, JP-A-2008-280523, or the like is excellent in instantaneous erasing property. When a mixture of such a three-component system which developed a color is heated to a temperature not lower than a specific color erasing temperature (Th), the color can be erased. Further, even if the mixture whose color was erased is cooled to a temperature not higher than Th, the color erased state is maintained. When the temperature of the mixture is further decreased, a color developing reaction between the leuco dye and the color developer is restored at a temperature not higher than a specific color restoring temperature Tc to return to the color developed state, whereby it is possible to cause a reversible color developing and erasing reaction. In particular, it is preferred that the color eraser to be used in the invention satisfies the relationship of Th>Tr>Tc when room temperature is represented by Tr.

Examples of the color eraser capable of exhibiting this thermal hysteresis include an alcohol, an ester, a ketone, an ether, and an acid amide.

Particularly preferred is an ester. Specific examples thereof include an ester of a carboxylic acid containing a substituted aromatic ring, an ester of a carboxylic acid containing an unsubstituted aromatic ring with an aliphatic alcohol, an ester of a carboxylic acid containing a cyclohexyl group in the molecule, an ester of a fatty acid with an unsubstituted aromatic alcohol or a phenol, an ester of a fatty acid with a branched aliphatic alcohol, an ester of a dicarboxylic acid with an aromatic alcohol or a branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These may be used by mixing two or more of them.

Meanwhile, as the color eraser to be used in the form of 1), a known color eraser disclosed in JP-A-2000-19770 or the like can be used. Examples thereof include cholesterol, stigmasterol, pregnenolone, methylandrostenediol, estradiol benzoate, epiandrostene, stenolone, β-sitosterol, pregnenolone acetate, β-cholestarol, 5,16-pregnadiene-3β-ol-20-one, 5α-pregnene-3β-ol-20-one, 5-pregnene-3β,17-diol-20-one-21-acetate, 5-pregnene-3β,17-diol-20-one-17-acetate, 5-pregnene-3β,21-diol-20-one-21-acetate, 5-pregnene-3β,17-diol diacetate, rockogenin, tigogenin, esmilagenin, hecogenin, diosgenin, cholic acid, cholic acid methyl esters, sodium cholate, lithocholic acid, lithocholic acid methyl esters, sodium lithocholate, hydroxycholic acid, hydroxycholic acid methyl esters, hyodeoxycholic acid, hyodeoxycholic acid methyl esters, testosterone, methyltestosterone, 11α-hydroxymethyltestosterone, hydrocortisone, cholesterol methyl carbonate, α-cholestanol, D-glucose, D-mannose, D-galactose, D-fructose, L-sorbose, L-rhamnose, L-fucose, D-ribodesose, α-D-glucose=pentaacetate, acetoglucose, diacetone-D-glucose, D-glucuronic acid, D-galacturonic acid, D-glucosamine, D-fructosamine, D-isosaccharic acid, vitamin C, etythrobic acid, trehalose, saccharose, maltose, cellobiose, gentiobiose, lactose, melibiose, raffinose, gentianose, melezitose, stachyose, methyl=α-glucopyranoside, salicin, amygdalin, euxanthic acid, cyclododecanol, hexahydrosalicylic acid, menthol, isomenthol, neomenthol, neoisomenthol, carbomenthol, α-carbomenthol, piperithol, α-terpineol, β-terpineol, γ-terpineol, 1-p-menthene-4-ol, isopulegol, dihydrocarveol, carveol, 1,4-cyclohexanediol, 1,2-cyclohexanediol, phloroglucitol, quercitol, inositol, 1,2-cyclododecane diol, quinic acid, 1,4-terpene, 1,8-terpene, pinol hydrate, betulin, borneol, isoborneol, adamantanol, norborneol, fenchol, camphor, and 1,2:5,6-diisopropylidene-D-mannitol.

The mixing ratios of the leuco dye, color developer, and color eraser vary depending on the density, color erasing and developing temperatures, or kinds of respective components, however, when the amount of the leuco dye is taken as 1, the amount of the color developer is from 0.1 to 100, preferably from 0.1 to 50, more preferably from 0.5 to 20, the amount of the color eraser is from 0.1 to 800, preferably from 5 to 200, more preferably from 5 to 100.

As the method for preparing the dispersion liquid of first fine particles containing at least a binder resin according to the embodiment, a known method can be used. For example, in the case of a dispersion liquid of binder resin particles, a polymerization method in which particles are obtained by polymerizing a monomer or a resin intermediate such as emulsion polymerization, seed polymerization, miniemulsion polymerization, suspension polymerization, interfacial polymerization, or in-situ polymerization; a phase inversion emulsification method in which a binder resin is softened using a solvent, an alkali, or a surfactant, or by heating to form an oil phase, and an aqueous phase containing water as a main component is added thereto to obtain particles; and a mechanical emulsification method in which a binder resin is softened using a solvent or by heating and mechanically pulverized into fine particles in an aqueous medium using a high-pressure pulverizer, a rotor-stator stirrer, or the like can be used. In the case of a dispersion liquid of release agent particles or a dispersion liquid of charge control agent particles, a mechanical pulverization method in which the respective material is mechanically pulverized into fine particles in an aqueous medium using a high-pressure pulverizer, a rotor-stator stirrer, a medium-type pulverizer, or the like can be used.

On the other hand, other than the method for preparing the respective fine particles separately, there is also a method in which the toner component materials are melt-kneaded or mixed, and then the resulting mixture is mechanically pulverized into fine particles in an aqueous medium using a high-pressure pulverizer, a rotor-stator stirrer, a medium-type pulverizer, or the like. When this method is used, the toner component fine particles can be prepared at a time, and therefore, the step can be simplified, and further, the release agent, charge control agent, and the like can be uniformly dispersed in the binder resin. Therefore, this method is an extremely superior production method.

The first fine particles can be obtained by, for example, subjecting a dispersion liquid of resin particles containing at least a binder resin to mechanical shearing to pulverize the resin particles into fine particles such that the resulting fine particles have a particle diameter smaller than that of the resin particles.

As an example of the mechanical shearing, a specific example of a preparation method using a high-pressure pulverizer which is one of the mechanical emulsification methods is shown below.

First, coarsely pulverized particles containing at least a binder resin are prepared.

The coarsely pulverized particles are obtained by a step of melt-kneading a mixture containing, for example, a binder resin and a release agent, and coarsely pulverizing the resulting kneaded material. The coarsely pulverized particles preferably have a volume average particle diameter of from 0.01 to 2 mm. When the volume average particle diameter thereof is less than 0.01 mm, strong stirring is required for dispersing the particles in an aqueous medium, and bubbles generated by the stirring tend to decrease dispersion of the mixture. Meanwhile, when the volume average particle diameter thereof exceeds 2 mm, because the particle diameter is larger than a gap provided in a shearing part of a mechanical stirrer, the particles are caught in the shearing part or a difference in the applied energy is generated between the inside and the outside of the mixture, therefore, particles having an uneven composition or an uneven particle diameter tend to be formed.

The coarsely pulverized particles more preferably have a volume average particle diameter of from 0.02 mm to 1 mm.

Subsequently, the coarsely pulverized particles are dispersed in an aqueous medium to form a dispersion liquid of the coarsely pulverized particles.

In the step of forming the dispersion liquid of the coarsely pulverized particles, a surfactant or an alkaline pH adjusting agent can be added to the aqueous medium.

By the addition of a surfactant, the coarsely pulverized particles can be easily dispersed in the aqueous medium due to the action of the surfactant adsorbed on the surfaces of the particles. The binder resin and the release agent which are toner components have low hydrophilicity and it is very difficult to disperse such components in water without a surfactant.

At this time, the concentration of the surfactant is preferably not lower than the critical micelle concentration thereof. Here, the critical micelle concentration means the minimum concentration of a surfactant necessary for forming micelles in water and can be determined by measuring the surface tension or electrical conductivity. When the surfactant is contained at a critical micelle concentration or higher, the components are more easily dispersed.

On the other hand, by the addition of an alkaline pH adjusting agent, the degree of dissociation of a dissociative functional group on the surface of the binder resin is increased or the polarity is increased, and therefore, the self-dispersibility can be improved.

Subsequently, the thus obtained dispersion liquid is subjected to defoaming as needed. Since the binder resin and the release agent which are toner components have low hydrophilicity, by using a surfactant, such components can be dispersed in water, however, not a few bubbles are incorporated during mixing. When a pulverization treatment of the post-step is performed using a high-pressure pulverizer in a state where the bubbles are incorporated in the mixture, the blank firing of the plunger of the high-pressure pump occurs and the operation of the plunger becomes unstable. In particular, when a plurality of plungers are mounted in a row for eliminating a pulsating current, the movement of the plurality of the plungers is controlled, and therefore, if blank firing occurs, the pulverization treatment cannot be performed in some cases. Further, the high-pressure pulverizer has a check valve, therefore, if bubbles are incorporated in the process liquid, the particles are liable to adhere to this check valve and the check valve is clogged. If the check valve is clogged, the process liquid does not flow and the pulverization treatment cannot be performed in some cases.

Examples of the defoaming method include defoaming under reduced pressure or in vacuo, defoaming by centrifugation, and addition of a defoaming agent. The defoaming method may be any as long as bubbles can be removed, however, in the case of adding a defoaming agent, it is necessary to select the agent which does not affect the post-treatment. Also, it is important that the agent does not remain in the resulting toner so as not to deteriorate the charging characteristic and the like. As a simple method, defoaming under reduced pressure is preferred. The process liquid is fed to a pressure-resistant vessel equipped with a stirrer, and the pressure in the vessel is reduced to around −0.09 MPa using a vacuum pump while stirring to effect defoaming.

The thus formed dispersion liquid may be subjected to wet pulverization as needed. By further reducing the particle diameter through the wet pulverization, the subsequent treatment may sometimes become stable.

Subsequently, the resulting dispersion liquid is subjected to mechanical shearing and the coarsely pulverized mixture is further pulverized to form fine particles.

Figure 5:
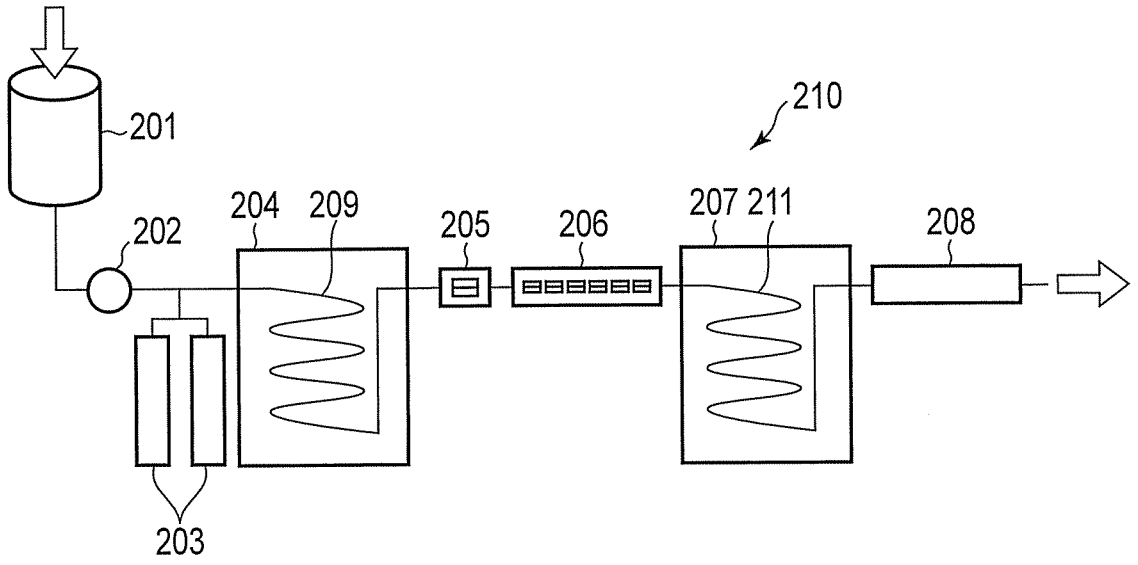
FIG. 5 is a schematic diagram showing an example of a high-pressure wet-type pulverizer to be used in the embodiment.

In FIG. 5, one example of a high-pressure wet-type pulverizer to be used in the embodiment is shown.

The high-pressure pulverizer is a device that applies a shearing force by allowing a material to pass through a fine nozzle while applying a pressure of from 10 MPa to 300 MPa by means of a high-pressure pump to pulverize the material into fine particles.

As shown in FIG. 5, a high-pressure homogenizer 210 which is one example of the high-pressure wet-type pulverizer has a configuration in which a hopper tank 201, a liquid feed pump 202, a high-pressure pump 203, a heating unit 204, a pulverizing unit 205, a pressure reducing unit 206, a cooling unit 207, and a pressure reducing unit 208 are arranged in this order, and includes pipes which connect the respective elements.

The hopper tank 201 is a tank in which a process liquid is fed. While the device is being operated, it is necessary to always fill the tank with a liquid so as not to send air into the device. When the particles in the process liquid have a large particle diameter and are likely to precipitate, a stirrer can be further installed in the tank.

The liquid feed pump 202 is installed for continuously feeding the process liquid to the high-pressure pump 203. Further, this liquid feed pump 202 is also effective in avoiding clogging of a check valve (not shown) installed in the high-pressure pump 203. As the pump 202, for example, a diaphragm pump, a tubing pump, a gear pump, or the like can be used.

The high-pressure pump 203 is a plunger pump and has check valves at a process liquid inlet port (not shown) and a process liquid outlet port (not shown). The number of plungers varies depending on the production scale, and 1 to 10 plungers are used. In order to reduce a pulsating current as much as possible, it is preferred that two or more plungers are used.

The heating unit 204 is provided with a high-pressure pipe 209 formed in a spiral shape so as to have a large heat exchange area in a heating device such as an oil bath. It does not matter whether this heating unit 204 is installed in the upstream side or downstream side of the high-pressure pump 203 in the flow direction of the dispersion liquid, however, it is necessary to install this heating unit 204 at least in the upstream side of the pulverizing unit 205. When the heating unit 204 is installed in the upstream side of the high-pressure pump 203, a heating device may be installed in the hopper tank 201, however, the time in which the process liquid is retained at a high temperature is long, therefore, the binder resin is liable to be hydrolyzed.

The pulverizing unit 205 includes a nozzle having a small diameter for applying a strong shearing force. The diameter and shape of the nozzle vary, however, the diameter thereof is preferably from 0.05 mm to 0.5 mm, and as for the shape thereof, a pass-through type nozzle or a collision type nozzle is preferred. Further, this nozzle may be configured in a multiple-stage structure. When a multiple-stage structure is employed, a plurality of nozzles having different diameters may be arranged. As for the configuration of the arrangement of such nozzles, either series or parallel configuration may be employed. As the material of the nozzle, diamond or the like which can withstand high pressure is used.

The cooling unit 207 is provided with a pipe 211 formed in a spiral shape so as to have a large heat exchange area in a bath in which cold water is allowed to continuously flow.

According to need, pressure reducing units 206 and 208 can be installed in the upstream and downstream of the cooling unit 207. The pressure reducing units 206 and 208 have a structure in which one or more cells or two-way valves having a flow path that is larger than the diameter of the nozzle of the pulverizing unit 207 and smaller than the diameter of the pipe connected thereto are arranged.

A treatment using this high-pressure pulverizer is performed as follows.

First, the process liquid is heated to a temperature not lower than the glass transition temperature Tg of the binder resin. The reason why the liquid is heated is to melt the binder resin.

This heating temperature varies depending on the melting characteristics of the binder resin. When the resin is easy to melt, the heating temperature may be set to low, however, when the resin is difficult to melt, the heating temperature should be set to high. Further, in the case of using a method of heating the dispersion liquid by continuously passing it through the heat exchanger, the flow rate of the dispersion liquid and the length of the pipe in the heat exchanger also affect the heating temperature. When the flow rate is high or the length of the pipe is small, a high temperature is needed, meanwhile, when the flow rate is low or the length of the pipe is large, the dispersion liquid is sufficiently heated, therefore, it is possible to perform the treatment at a low temperature. When the flow rate is from 300 to 400 cc/min, the heat exchange pipe is a high-pressure pipe having a diameter of ⅜ inch and a length of 12 m, the Tg of the binder resin is 60° C., the softening point Tm of a toner is 130° C., the heating temperature may be set to 100° C. to 200° C. The measurement of the softening point of a toner is performed by a temperature raising method using Flow Tester CFT-500 manufactured by Shimadzu Corporation, and the point on a curve which corresponds to a descent amount of the plunger of 2 mm on the chart is taken as the softening point.

Then, the dispersion liquid thus heated is subjected to shearing under application of a pressure of 10 MPa or more. At this time, the shearing force is applied by the nozzle. In passing through the nozzle under application of a high pressure of 10 MPa or more, the molten toner component is pulverized into fine particles. The pressure at this time may be from 10 MPa to 300 MPa.

Finally, the dispersion liquid is cooled to a temperature not higher than the Tg of the binder resin. By this cooling, the molten fine particles are solidified. Since the process liquid is rapidly cooled, aggregation or coalescence due to cooling is difficult to occur.

According to need, a back-pressure may be applied to the upstream or downstream of the cooling unit or a pressure may be reduced. Application of back-pressure or reduction in pressure is performed for returning the pressure of the process liquid after passing through the nozzle to close to atmospheric pressure in a single step (by application of back-pressure) or in multiple steps (by reduction in pressure) so as not to release the process liquid to atmospheric pressure immediately after passing through the nozzle. The pressure after passing through a back-pressure applying unit or a pressure reducing unit is from 0.1 MPa to 10 MPa, preferably from 0.1 MPa to 5 MPa. It is more preferred that in this pressure reducing unit, a plurality of cells or valves with different diameters are arranged. By reducing the pressure in multiple steps, few coarse particles are generated and fine particles having a sharp particle size distribution can be obtained.

As described above, the dispersion liquid of first fine particles containing a binder resin can be obtained.

Subsequently, a specific example of the method for preparing the dispersion of first fine particles containing at least a binder resin by emulsion polymerization which is one of the polymerization methods is described.

First, an oil phase component in which a vinyl polymerizable monomer and optionally a chain transfer agent are mixed is prepared. The resulting oil phase component is emulsified and dispersed in an aqueous phase component which is an aqueous solution of a surfactant, a water-soluble polymerization initiator is added thereto, and the resulting mixture is heated to allow polymerization to proceed. In the oil phase component, a release agent, a charge control agent, or the like which is a toner component may be mixed. Further, a dispersion in which fine particles of a release agent, a charge control agent, or the like are dispersed in an aqueous medium is added to the reaction mixture during polymerization, and such a component can be incorporated in the emulsion-polymerized particles. By this emulsion polymerization, a dispersion of fine particles containing toner components including at least a polymeric particles and having a size of from 0.01 to 1 μm can be prepared. As for the emulsion polymerization method, polymerization may be performed by adding dropwise the oil phase component to the aqueous phase component, or the polymerization initiator may be added again during polymerization for adjusting the molecular weight.

Subsequently, a specific example of the method for preparing the dispersion of first fine particles containing at least a binder resin by phase inversion emulsification method is described.

First, an oil phase component containing toner components including at least a binder resin is melted by heating. Then, an aqueous solution containing a surfactant and a pH adjusting agent is gradually added thereto. By adding the aqueous solution thereto, the phase is inverted from W/O to 0/W. After completion of phase inversion, the resulting mixture is cooled, whereby a dispersion of fine particles of toner components containing at least polymeric particles, that forms a binder resin and having a size of from 0.01 to 5 μm can be prepared. To the oil phase component, a surfactant, a pH adjusting agent, a solvent, ion exchanged water, or the like may be added in advance. In particular, in the case of adding a solvent, the viscosity of the oil phase component is decreased, therefore, it is not necessary to perform heating in some cases. However, if a solvent is used, it is necessary to remove the solvent after completion of phase inversion emulsification.

Hereinafter, an example of the method for aggregating and fusing second fine particles containing at least a color developable compound such as a leuco dye, a color developer, and a color eraser in part or in whole and first fine particles containing at least a binder resin in a medium such as water of the embodiment is described.

Here, the first fine particles containing at least a binder resin may be, for example, a mixture of fine particles of a binder resin, fine particles of a release agent, and fine particles of a charge control agent; or may be fine particles each containing a release agent or a charge control agent in a binder resin; or may be a mixture thereof.

First, an aggregating agent is added to a dispersion liquid of fine particles. The addition amount of the aggregating agent varies depending on the dispersion stability of the fine particles, and when the fine particles have high dispersion stability, the addition amount is large, and when the fine particles have low dispersion stability, the addition amount is small. Also, the addition amount varies depending on the kind of the aggregating agent. When aluminum sulfate is used as the aggregating agent, it may be added in an amount of from 0.1 to 50 wt %, preferably from 0.5 to 10 wt % based on the amount of fine particles. When an aggregating agent with high aggregating performance such as aluminum sulfate is used, after adding the aggregating agent, aggregated particles having a particle diameter of from 0.1 to 10 μm are obtained. On the other hand, when an aggregating agent with low aggregating performance such as sodium chloride is used, the fine particles are sometimes not aggregated even if the aggregating agent is added. When the aggregating agent is added, in order to prevent rapid aggregation of the fine particles, a rotor stator disperser may be used. Further, in order to prevent rapid aggregation of the fine particles, before the aggregating agent is added, a pH adjusting agent or a surfactant may be added to the dispersion liquid of the fine particles. By these operations, it becomes possible to make the particle diameter of the finally obtained toner uniform.

Subsequently, aggregation by heating is performed. By heating, aggregated particles having a particle diameter of from 2 μm to a target particle diameter are prepared.

Then, fusion by heating is performed. To the resulting aggregated particles, a stabilizer such as a pH adjusting agent or a surfactant is added as needed thereby to stabilize the aggregated particles, and thereafter, the particles are heated at least to a temperature not lower than the Tg of the binder resin, whereby the surfaces of the aggregated particles are fused. By this fusion, a final target particle diameter is obtained.

The aggregation and fusion may be sometimes performed simultaneously according to the kind of fine particles, the solid content concentration, or the kind of aggregating agent.

Further, the stirring conditions for the aggregation and fusion have a large influence on the particle diameter and particle size distribution. The stirring rate condition is preferably a condition capable of applying a proper shearing force. If the shearing force is too small, the particle diameter is increased and coarse particles are liable to be generated. Meanwhile, if the shearing force is too large, the particle diameter is decreased, and fine powder is liable to be generated. Further, in a reaction vessel, a baffle may be installed. The baffle has an effect of suppressing incorporation of bubbles, an effect of making the stirred state in the vessel uniform, and an effect of increasing the shearing force. Other than the stirring conditions, a temperature increasing rate, an additive feeding rate, or the like are also have a large influence on the particle diameter and particle size distribution.

According to need, the surfaces of the aggregated particles can be coated with a resin. As the coating methods, the following three methods are used: a first method in which resin particles or the like are added to the dispersion liquid of the aggregated particles, the resin particles or the like are adhered to the surfaces of the aggregated particles by addition of an aggregating agent, adjustment of the pH, or the like, and the adhered resin particles or the like are fused on the surfaces of the aggregated particles; a second method in which the surfaces of the aggregated particles are wrapped or swollen with a polymerizable monomer by adding the monomer to a solution containing the aggregated particles, and then, the monomer is polymerized; and a third method in which after the aggregated particles are fused, the resulting fused particles are washed and dried, and then, resin particles or the like are mechanically adhered to the surfaces of the fused particles using a hybridizer or the like.

Among these methods, the first method is simple and can provide a toner with a high coverage. The resin particles to be used for coating in this method can be obtained by the above-mentioned pulverization method.

By this coating, it becomes possible to wrap the color material or the release agent on the surfaces of the toner particles, and the stability of an image during continuous sheet feeding is improved.

After forming the aggregated and fused particles according to the embodiment, by performing washing, solid-liquid separation, and drying, powdery matter of aggregated and fused particles is obtained. By adding an external additive to the powdery matter, a toner can be obtained.

Examples of a production device according to the embodiment include the following devices.

A kneader is not particularly limited as long as it can melt-knead materials, and examples thereof include a single-screw extruder, a twin-screw extruder, a pressure kneader, a Banbury mixer, and a Brabender mixer. Specific examples thereof include FCM (manufactured by Kobe Steel, Ltd.), NCM (manufactured by Kobe Steel, Ltd.), LCM (manufactured by Kobe Steel, Ltd.), ACM (manufactured by Kobe Steel, Ltd.), KTX (manufactured by Kobe Steel, Ltd.), GT (manufactured by Ikegai, Ltd.), PCM (manufactured by Ikegai, Ltd.), TEX (manufactured by the Japan Steel Works, Ltd.), TEM (manufactured by Toshiba Machine Co., Ltd.), ZSK (manufactured by Warner K.K.), and KNEADEX (manufactured by Mitsui Mining Co., Ltd.).

A grinder is not particularly limited as long as it can grind materials in a dry state, and examples thereof include a ball mill, an atomizer, a Bantam mill, a pulverizer, a hammer mill, a roll crusher, a cutter mill, and a jet mill.

A pulverizer is not particularly limited as long as it can pulverize materials in a wet state, and examples thereof include a high-pressure pulverizer such as Nanomizer (manufactured by Yoshida Kikai Co., Ltd.), Altimizer (manufactured by Sugino Machine, Ltd.), NANO3000 (manufactured by Beryu Co., Ltd.), Microfluidizer (manufactured by Mizuho Industrial Co., Ltd.), and Homogenizer (manufactured by Izumi Food Machinery Co., Ltd.); a rotor stator stirrer such as Ultra Turrax (manufactured by IKA Japan K.K.), T.K. Auto Homo Mixer (manufactured by Primix Corporation), T.K. Pipeline Homo Mixer (manufactured by Primix Corporation), T.K. Filmics (manufactured by Primix Corporation), Clear mix (manufactured by M-Technique Co., Ltd.), Clear SS5 (manufactured by M-Technique Co., Ltd.), Cavitron (manufactured by Eurotec, Ltd.), and Fine Flow Mill (manufactured by Pacific Machinery & Engineering Co., Ltd.); and a medium-type stirrer such as Visco mill (manufactured by Aimex Co., Ltd.), Apex mill (manufactured by Kotobuki Industries Co., Ltd.), Star Mill (manufactured by Ashizawa Finetech, Ltd.), DCP Super flow (manufactured by Nippon Eirich Co., Ltd.), MP Mill (manufactured by Inoue Manufacturing Co., Ltd.), Spike Mill (manufactured by Inoue Manufacturing Co., Ltd.), Mighty Mill (manufactured by Inoue Manufacturing Co., Ltd.), and SC Mill (manufactured by Mitsui Mining Co., Ltd.). Such a pulverizer can also be used when toner component particles and an aggregating agent are mixed.

As a washing device, for example, a centrifugal separator, a filter press, or the like is preferably used. As a washing liquid, for example, water, ion exchanged water, purified water, water adjusted to an acidic pH, water adjusted to an alkaline pH, or the like is used.

As a drying device, a vacuum dryer, an air flow dryer, a fluidized dryer, or the like is preferably used.

Examples of a dry mixer include Henschel Mixer (manufactured by Mitsui Mining Co., Ltd.), Super Mixer (manufactured by Kawata MFG Co., Ltd.), Ribocorn (manufactured by Okawara Corporation), Nauta Mixer (manufactured by Hosokawa Micron Corporation), Turbulizer (manufactured by Hosokawa Micron Corporation), Cyclomix (manufactured by Hosokawa Micron Corporation), Spiralpin Mixer (manufactured by Pacific Machinery & Engineering Co., Ltd.) and Lodige Mixer (manufactured by Matsubo Corporation).

As the materials to be used in the embodiment, any materials known as toner materials such as a polymerizable monomer, a chain transfer agent, a crosslinking agent, a polymerization initiator, a surfactant, an aggregating agent, a pH adjusting agent, a defoaming agent, a resin, and a release agent.

As the vinyl polymerizable monomer, aromatic vinyl monomers such as styrene, methylstyrene, methoxystyrene, phenylstyrene, and chlorostyrene; ester monomers such as methyl acrylate, ethyl acrylate, butyl acrylate, methyl methacrylate, ethyl methacrylate, and butyl methacrylate; carboxylic acid-containing monomers such as acrylic acid, methacrylic acid, fumaric acid, or maleic acid; amine monomers such as aminoacrylate, acrylamide, methacrylamide, vinylpyridine, and vinylpyrrolidone; and derivatives thereof can be used alone or by mixing two or more of them. As a polycondensation polymerizable monomer, an alcohol component or a carboxylic acid component can be used. Examples of the alcohol component include aliphatic diols such as ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,4-butenediol, 1,2-propanediol, 1,3-butanediol, neopentyl glycol, and 2-butyl-2-ethyl-1,3-propanediol; aromatic diols of an alkylene oxide adduct of bisphenol A such as polyoxypropylene(2.2)-2,2-bis(4-hydroxyphenyl)propane and polyoxyethylene (2.2)-2,2-bis(4-hydroxyphenyl)propane; trihydric or higher polyhydric alcohols such as glycerin and pentaerythritol; and derivatives thereof, which can be used alone or by mixing two or more of them. Examples of the carboxylic acid component include aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; alicyclic dicarboxylic acids such as cyclohexanedicarboxylic acid; aromatic dicarboxylic acids such as phthalic acid, isophthalic acid, and terephthalic acid; tri- or higher polycarboxylic acids such as trimellitic acid and pyromellitic acid; and derivatives thereof, which can be used alone or by mixing two or more of them.

As the chain transfer agent, carbon tetrabromide, dodecylmercaptan, trichlorobromomethane, dodecanethiol, or the like is used.

As the crosslinking agent, a compound having two or more unsaturated bonds such as divinyl benzene, divinyl ether, divinyl naphthalene, or diethylene glycol methacrylate is used.

It is necessary to appropriately select the polymerization initiator according to the polymerization method, and there are two kinds of polymerization initiators: a water-soluble initiator and an oil-soluble initiator. As the water-soluble initiator, a persulfate salt such as potassium persulfate or ammonium persulfate; an azo compound such as 2,2-azobis (2-aminopropane); hydrogen peroxide, benzoyl peroxide, or the like is used. Further, as the oil-soluble initiator, an azo compound such as azobisisobutyronitrile or azobisdimethylvaleronitrile; a peroxide compound such as benzoyl peroxide or dichlorobenzoil peroxide is used. A redox initiator may also be used as needed.

As the surfactant, an anionic surfactant, a cationic surfactant, an amphoteric surfactant, a nonionic surfactant, or the like can be used. Examples of the anionic surfactant include a fatty acid salt, an alkyl sulfate ester salt, a polyoxyethylene alkyl ether sulfate ester salt, an alkyl benzene sulfonate salt, an alkyl napthalene sulfonate salt, a dialkyl sulfosuccinate salt, an alkyl diphenyl ether disulfonate salt, a polyoxyethylene alkyl ether phosphate salt, an alkenyl succinate salt, an alkane sulfonate salt, a napthalene sulfonic acid formalin condensate salt, an aromatic sulfonic acid formalin condensate salt, a polycarboxylic acid, and a polycarboxylate salt. Examples of the cationic surfactant include an alkyl amine salt and an alkyl quaternary ammonium salt. Examples of the amphoteric surfactant include an alkyl betaine and an alkylamine oxide. Examples of the nonionic surfactant include a polyoxyethylene alkyl ether, a polyoxyalkylene alkyl ether, a polyoxyethylene derivative, a sorbitan fatty acid ester, polyoxyethylene sorbitan fatty acid ester, a polyoxyethylene sorbitol fatty acid ester, a glycerin fatty acid ester, a polyoxyethylene fatty acid ester, a polyoxyethylene hardened caster oil, a polyoxyethylene alkylamine, and an alkyl alkanolamide. These compounds may be used alone or in combination of two or more of them.

As the aggregating agent, a monovalent salt such as sodium chloride, potassium chloride, lithium chloride, or sodium sulfate; a divalent salt such as magnesium chloride, calcium chloride, magnesium sulfate, calcium nitrate, zinc chloride, ferric chloride, or ferric sulfate; or a trivalent salt such as aluminum sulfate or aluminum chloride can be used. Further, an organic coagulating agent or an organic polymeric aggregating agent, for example, a quaternary ammonium salt such as polyhydroxy propyldimethyl ammonium chloride and polydiallyl dimethyl ammonium chloride can be used.

As the pH adjusting agent, an acid such as hydrochloric acid, sulfuric acid, nitric acid, acetic acid, citric acid, or phosphoric acid; or an alkali such as sodium hydroxide, potassium hydroxide, ammonia, or an amine compound can be used. Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane, and N,N-diethyl-1,3-diaminopropane. A surfactant that exhibits acidity or alkalinity can also be used as the pH adjusting agent.

Examples of the defoaming agent include a lower alcohol-based defoaming agent, an organic polar compound-based defoaming agent, a mineral oil-based defoaming agent, and a silicone-based defoaming agent. As the lower alcohol-based defoaming agent, methanol, ethanol, isopropanol, butanol, or the like can be used. As the organic polar compound-based defoaming agent, 2-ethylhexanol, amyl alcohol, diisobutyl carbinol, tributyl phosphate, oleic acid, tall oil, a metal soap, sorbitan monolaurate ester, sorbitan monooleate ester, sorbitan trioleate ester, a low-molecular weight polyethylene glycol oleate ester, an EO-low mol adduct of nonylphenol, a Pluronic type EO-low mol adduct, polypropylene glycol, a derivative thereof, or the like can be used. As the mineral oil-based defoaming agent, a surfactant combination of a mineral oil, a surfactant combination of a mineral oil and a fatty acid metal salt, or the like can be used. As the silicone defoaming agent, a silicone resin, a surfactant combination of a silicone resin, an inorganic powder combination of a silicone resin, or the like can be used.

Examples of the binder resin include styrene resins such as polystyrene, a styrene-butadiene copolymer, and a styrene-acrylic copolymer; ethylene resins such as polyethylene, a polyethylene-vinyl acetate copolymer, a polyethylene-norbornene copolymer, and a polyethylene-vinyl alcohol copolymer; a polyester resin, an acrylic resin, a phenol resin, an epoxy resin, an allyl phthalate resin, a polyamide resin, and a maleic acid resin. These resins may be used alone or in combination of two or more of them. When such a resin is polymerized, the above-mentioned polymerizable monomer, chain transfer agent, crosslinking agent, polymerization initiator, and the like can be used. Further, these resins preferably have a glass transition temperature of from 40 to 80° C. and a softening point of from 80 to 180° C. In particular, a polyester resin is preferred because it has a favorable fixability. Further, the polyester resin preferably has an acid value of 1 or more. With the use of the polyester resin having an acid value, the effect of the alkaline pH adjusting agent is exhibited during pulverization, and fine particles having a small particle diameter can be obtained.

Examples of the release agent include aliphatic hydrocarbon waxes such as a low molecular weight polyethylene, a low molecular weight polypropylene, a polyolefin copolymer, polyolefin wax, microcrystalline wax, paraffin wax, and Fischer-Tropsch wax; oxides of an aliphatic hydrocarbon wax such as an oxidized polyethylene wax and a block copolymer thereof; vegetable waxes such as candelilla wax, carnauba wax, Japan wax, jojoba wax, and rice wax; animal waxes such as bees wax, lanolin, and whale wax; mineral waxes such as ozokerite, ceresin, and petrolatum; and waxes containing a fatty acid ester as a main component such as montanate ester wax, and castor wax; and materials obtained by deoxidization of a part or the whole of a fatty acid ester such as deoxidized carnauba wax. Further, saturated linear fatty acids such as palmitic acid, stearic acid, montanic acid, and a long chain alkyl carboxylic acid having a long chain alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and a long chain alkyl alcohol having a long chain alkyl group; polyhydric alcohols such as sorbitol; fatty acid amides such as linoleic acid amide, oleic acid amide, and lauric acid amide; saturated fatty acid bisamides such as methylenebis stearic acid amide, ethylenebis caprylic acid amide, ethylenebis lauric acid amide, and hexamethylenebis stearic acid amide; unsaturated fatty acid amides such as ethylenebis oleic acid amide, hexamethylenebis oleic acid amide, N,N'-dioleyladipic acid amide, and N,N'-dioleylsebaccic acid amide; aromatic bisamides such as m-xylenebisstearic acid amide and N,N'-distearylisophthalic acid amide; fatty acid metal salts (generally called metal soaps) such as calcium stearate, calcium laurate, zinc stearate, and magnesium stearate; waxes obtained by grafting of a vinyl monomer such as styrene or acrylic acid on an aliphatic hydrocarbon wax; partially esterified products of a fatty acid and a polyhydric alcohol such as behenic acid monoglyceride; and methyl ester compounds having a hydroxyl group obtained by hydrogenation of a vegetable fat or oil can be exemplified.

Further, a charge control agent, an external additive, or the like can be added as needed.

As the charge control agent, for example, a metal-containing azo compound is used, and the metal element is preferably a complex or a complex salt of iron, cobalt or chromium or a mixture thereof. Other than these, a metal-containing salicylic acid derivative compound can also be used, and the metal element is preferably a complex or a complex salt of zirconium, zinc, chromium, or boron, or a mixture thereof.

As the external additive, inorganic fine particles can be added and mixed into the surfaces of the toner particles in an amount of from 0.01 to 20% by weight based on the total weight of the toner for adjusting the fluidity or chargeability of the toner particles. As such inorganic fine particles, silica, titania, alumina, strontium titanate, tin oxide, and the like can be used alone or by mixing two or more of them. It is preferred that as the inorganic fine particles, inorganic fine particles surface-treated with a hydrophobizing agent are used from the viewpoint of improvement of environmental stability. Further, other than such inorganic oxides, resin fine particles having a particle diameter of 1 μm or less may be externally added for improving the cleaning property.

Figure 6:
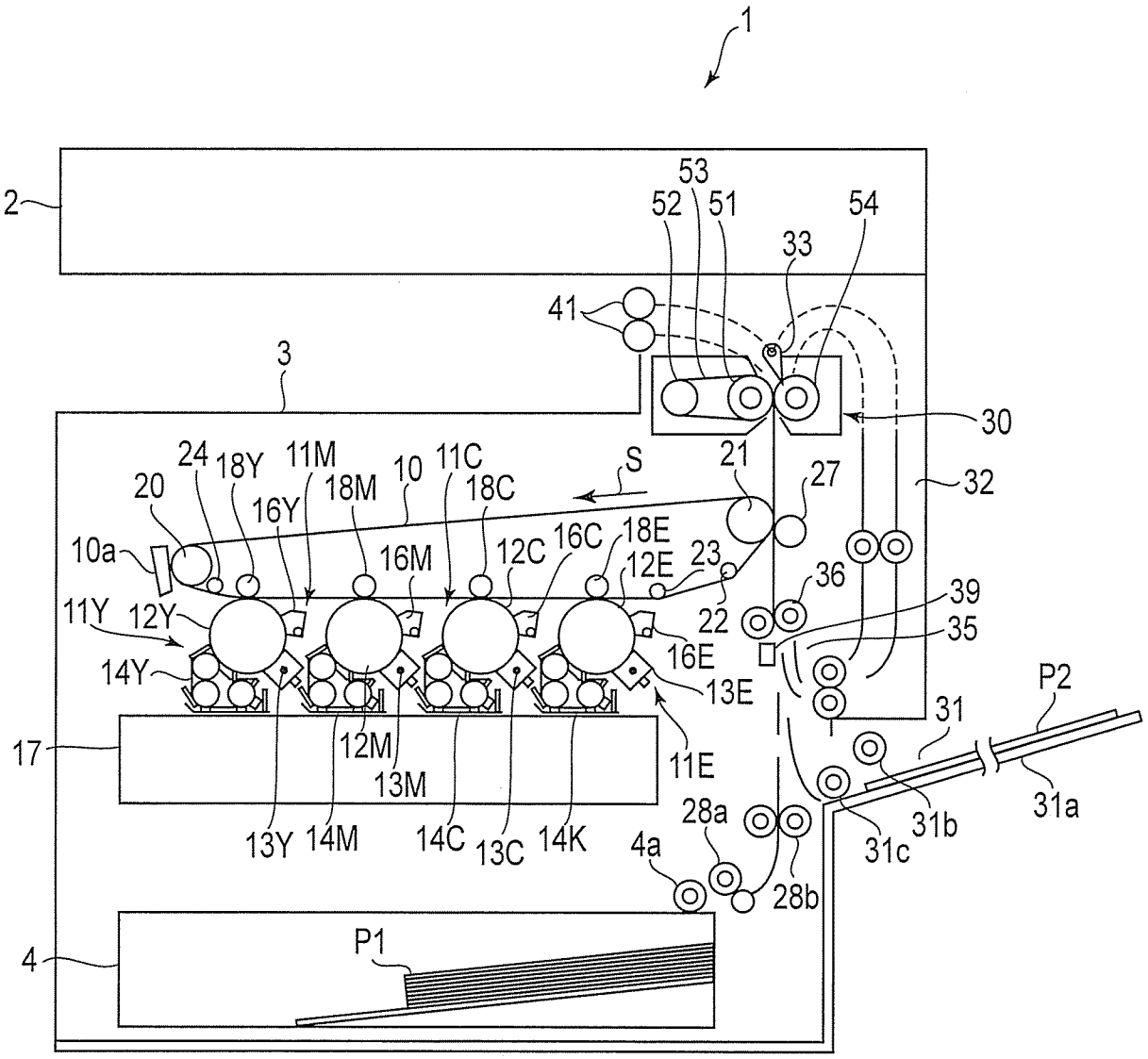
FIG. 6 is a schematic diagram showing a configuration of a copier to which a toner according to the embodiment can be applied.
Figure 7:
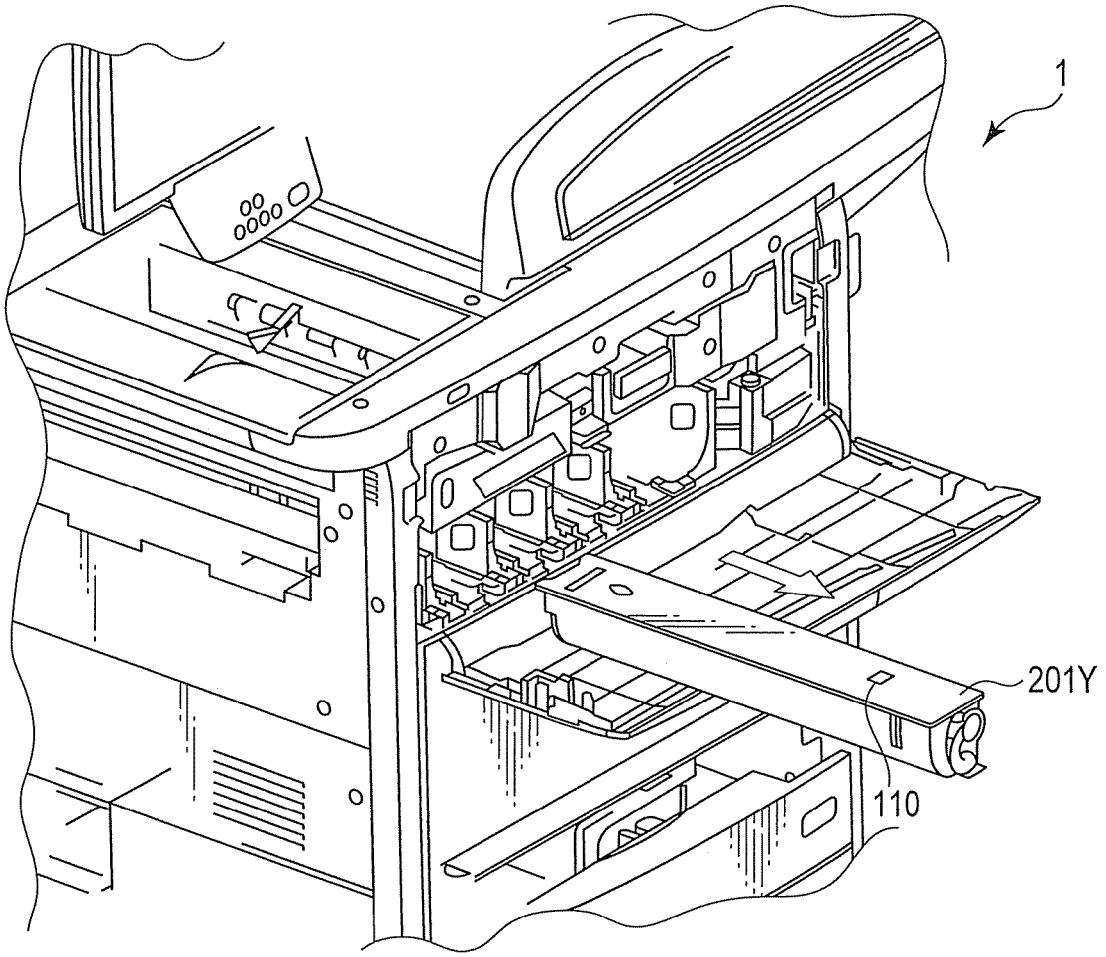
FIG. 7 is a schematic diagram of a state in which a toner cartridge is drawn out from the image forming apparatus.
Figure 8:
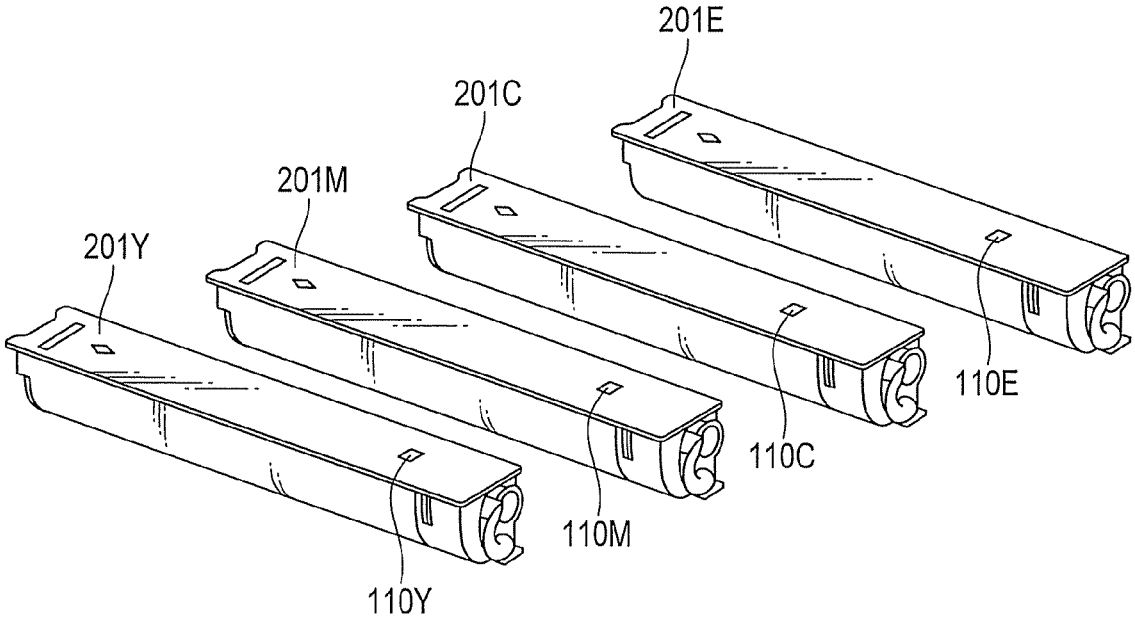
FIG. 8 is a schematic diagram of an example of the toner cartridge.

FIG. 6 is a schematic diagram showing a configuration of a copier to which the toner according to the embodiment can be applied.

As shown in FIG. 6, a color copier MFP (e-studio 4520c) 1 employing a four-drum tandem system is provided with a scanner unit 2 and a paper discharge unit 3 in the upper part.

The color copier 1 has four sets of image forming stations 11Y, 11M, 11C, and 11E of yellow (Y), magenta (M), cyan (C), and blue(B) arranged in parallel along the lower side of an intermediate transfer belt (intermediate transfer medium) 10. The color copier 1 has two image forming modes including (1) a mode of forming images using toners selected from three colors Y, M and C, and (2) a mode of forming images using only a blue toner. For the evaluation of the toners, image formation was performed by selecting the mode (1) or mode (2)

The image forming stations 11Y, 11M, 11C, and 11E have photoreceptor drums (image carrying members) 12Y, 12M, 12C, and 12E, respectively. Around the photoreceptor drums 12Y, 12M, 12C, and 12E, electric chargers 13Y, 13M, 13C, and 13E, developing devices 14Y, 14M, 14C, and 14E, and photoconductor cleaning devices 16Y, 16M, 16C, and 16E are provided along the rotational direction of the arrow m, respectively. Exposure lights by a laser exposure device (latent image forming device) 17 are applied to areas between the respective electric chargers 13Y, 13M, 13C, and 13E to the developing devices 14Y, 14M, 14C, and 14E around the photoreceptor drums 12Y, 12M, 12C, and 12E, and electrostatic latent images are formed on the photoreceptor drums 12Y, 12M, 12C, and 12E, respectively.

The developing devices 14Y, 14M, 14C and 14E each have a two-component developing agent containing a toner of yellow (Y), magenta (M), cyan (C), and blue(B) and a carrier. These toners are erasable toners respectively. The respective developing devices 14Y, 14M, 14C, and 14E supply the toner to the electrostatic latent images on the photoreceptor drums 12Y, 12M, 12C, and 12E, respectively. The intermediate transfer belt 10 is tensioned by a backup roller 21, a driven roller 20, and first to third tension rollers 22 to 24. The intermediate transfer belt 10 faces and is in contact with the photoreceptor drums 12Y, 12M, 12C, and 12E. At the positions of the intermediate transfer belt 10 facing the photoreceptor drums 12Y, 12M, 12C, and 12E, primary transfer rollers 18Y, 18M, 18C, and 18E for primarily transferring toner images on the photoreceptor drums 12Y, 12M, 12C, and 12E onto the intermediate transfer belt 10 are provided. The primary transfer rollers 18Y, 18M, 18C, and 18E are each a conductive roller, and apply a primary transfer bias voltage to the respective primary transfer parts.

In a secondary transfer part as a transfer position supported by the backup roller 21 of the intermediate transfer belt 10, a secondary transfer roller 27 is provided. In the secondary transfer part, the backup roller 21 is a conductive roller and a predetermined secondary transfer bias is applied thereto. When a sheet of paper (final transfer medium) which is a print target passes between the intermediate belt 10 and the second transfer roller 27, the toner image on the intermediate transfer belt 10 is secondarily transferred onto the paper. After completion of the secondary transfer, the intermediate transfer belt 10 is cleaned by a belt cleaner 10*a*.

A paper feed cassette 4 for feeding a sheet of paper in the direction toward the secondary transfer roller 27 is provided below the laser exposure device 17. On the right side of the color copier 1, a manual feed mechanism 31 for manually feeding a sheet of paper is provided.

A pickup roller 4*a*, a separating roller 28*a*, a conveying roller 28*b*, and a resist roller pair 36 are provided between the paper feed cassette 4 and the secondary transfer roller 27, and these are constituent members of a paper feed mechanism. A manual feed pickup roller 31*b* and a manual feed separating roller 31*c* are provided between a manual feed tray 31*a* of the manual feed mechanism 31 and the resist roller pair 36.

Further, a medium sensor 39 for detecting the kind of a sheet of paper is disposed on a vertical conveying path 34 for conveying a sheet of paper in the direction from the paper feed cassette 4 or the manual feed tray 31*a* to the secondary transfer roller 27. In the color copier 1, the conveying speed of a sheet of paper, a transfer condition, a fixing condition, and the like can be controlled according to the detection result of the medium sensor 39. Further, a fixing device 30 is provided in the downstream of the secondary transfer part along the direction of the vertical conveying path 34.

The sheet of paper taken out from the paper feed cassette 4 or fed from the manual feed mechanism 31 is conveyed to the fixing device 30 along the vertical conveying path 34 through the resist roller pair 36 and the secondary transfer roller 27. The fixing device 30 has a heating roller 51, a driven roller 52, a fixing belt 53 tensioned by the heating roller 51 and the driven roller 52, and a facing roller 54 disposed to face the heating roller 51 via the fixing belt 53. The sheet of paper having the toner image transferred in the second transfer part is guided between the fixing belt 53 and the facing roller 54 and heated by the heating roller 51, whereby the toner image transferred onto the sheet of paper was fixed through the heat treatment. A gate 33 is provided in the downstream of the fixing device 30, and distributes the sheet of paper in the direction toward a paper discharge roller 41 or the direction toward a re-conveying unit 32. The sheet of paper guided to the paper discharge roller 41 is discharged to the paper discharge unit 3. Further, the sheet of paper guided to the re-conveying unit 32 is again guided in the direction toward the secondary transfer roller 27.

The image forming station 11Y integrally includes the photoreceptor drum 12Y and a process means, and is provided so as to be attachable to and detachable from the color copier machine 1 as a process unit. The image forming stations 11M, 11C, and 11E each have the same configuration as the image forming station 11Y.

A copying machine 1 can be described in detail with using FIG. 7, FIG. 8, FIG. 9 and FIG. 10.

A color copy machine 1 is provided with toner cartridges 201Y, 201M, 201C and 201E for supplying developing devices 14Y, 14M, 14C and 14E with a toner. The toner is explained later. The toner cartridges 201Y, 201M, 201C and 201E are a replaceable unit respectively and mounted to color copy machine 1

Figure 9:
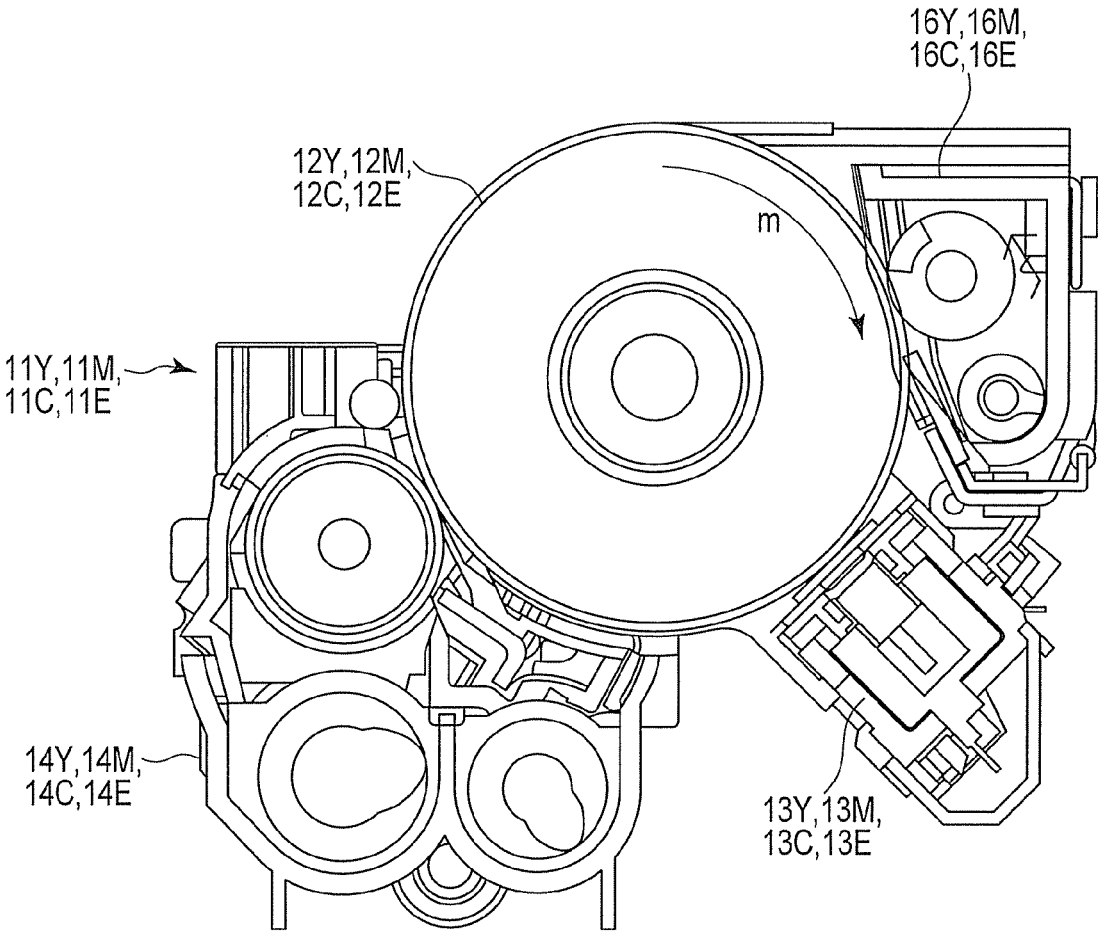
FIG. 9 is a sectional view showing an example of a process cartridge.
Figure 10:
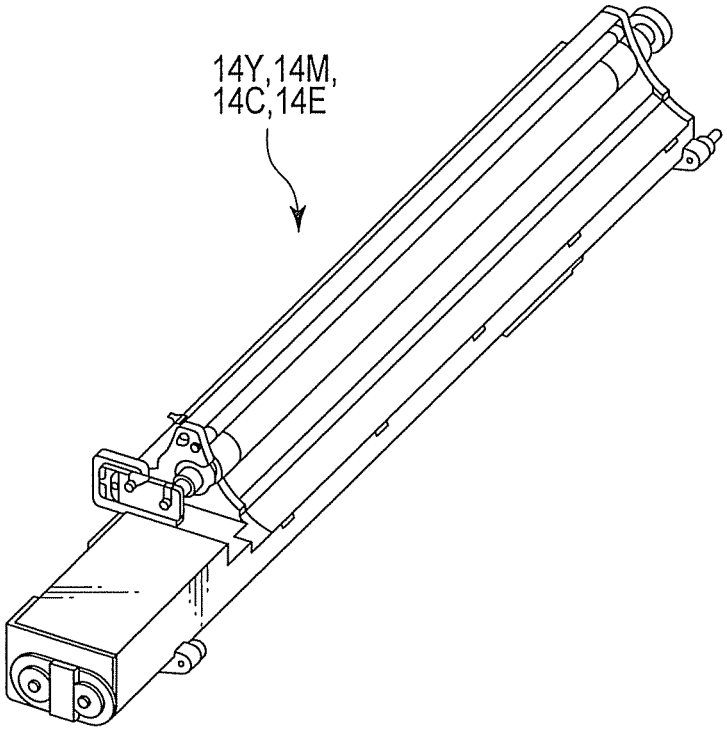
FIG. 10 is a schematic diagram showing one embodiment of a developing device cartridge.

FIG. 9 is a sectional view showing the image forming station 11Y as a process cartridge The photoreceptor drum 12Y, the electric charger 13Y, the developing device 14Y, and the photoconductor cleaning device 16Y are united as a process cartridge. The image forming stations 11M, 11C, and 11E each have the same configuration as the image forming station 11Y In FIG. 9, the photoreceptor drum 12Y, the electric charger 13Y, the developing device 14Y, and the photoconductor cleaning device 16Y are all united. But the photoreceptor drum 12Y and at least one process means can be united. Further, as shown in FIG. 10 the developing device 14Y can be a single process unit by itself that is able to be attachable to the photoreceptor drum 12Y.

EXAMPLES

Preparation of Dispersion of Color Developed Particles Containing Leuco Dye, Color developer, and Color Eraser Preparation of Dispersion of Color Developed Particles C1

Hereafter part means part by weight and % means % by weight.

A solution obtained by uniformly heat-dissolving a composition containing 2 parts of 3-(4-diethylamino-2-hexyloxyphenyl)-3-(1-ethyl-2-methylindol-3-yl)-4-azaphthalide as a leuco dye, 4 parts of 1,1,-bis(4'-hydroxyphenyl)hexafluoropropane, and 4 parts of 1,1-bis(4'-hydroxyphenyl)n-decane as color developers, and 50 parts of 4-benzyloxyphenylethyl caprylate as a color eraser, and adding 30 parts of an aromatic polyvalent isocyanate prepolymer and 40 parts of ethyl acetate thereto as encapsulating agents was emulsified and dispersed in 300 parts of an aqueous solution of 8 wt % polyvinyl alcohol, and the resulting mixture was kept stirring at 90° C. for about 1 hour. Then, as a reaction agent, 2.5 parts of a water-soluble aliphatic denatured amine was added thereto, and the resulting mixture was further kept stirring for 6 hours, whereby colorless encapsulated particles were obtained. Further, the thus obtained dispersion of the encapsulated particles was placed in a freezer to develop a color, whereby a dispersion of blue color developed particles C1 was obtained. The average particle diameter of the thus obtained color developed particles C1 was measured using SALD-7000 (manufactured by Shimadzu Corporation) and found to be 3 μm. Further, the complete color erasing temperature Th was 62° C., and the complete color developing temperature Tc was −14° C.

Preparation of Dispersion of Color Developed Particles C2

A solution obtained by heat-dissolving a composition containing 1 part of 3-(2-ethoxy-4-diethylaminophenyl)-3-(1-ethyl-2-methylindol-3-yl)-4-azaphthalide as a leuco dye, 5 parts of 2,2-bis(4-hydroxyphenyl)hexafluoropropane as a color developer, and 50 parts of a diester compound of pimelic acid with 2-(4-benzyloxyphenyl)ethanol as a color eraser, and adding 20 parts of an aromatic polyvalent isocyanate prepolymer and 40 parts of ethyl acetate thereto as encapsulating agents was added to 250 parts of an aqueous solution of 8% polyvinyl alcohol and emulsified and dispersed therein, and the resulting mixture was kept stirring at 90° C. for about 1 hour. Then, as a reaction agent, 2 parts of a water-soluble aliphatic denatured amine was added thereto, and the resulting mixture was further kept stirring for about 3 hours while maintaining the temperature of the mixture at 90° C., whereby colorless encapsulated particles were obtained. Further, the thus obtained dispersion of the encapsulated particles was placed in a freezer to develop a color, whereby a dispersion of blue color developed particles C2 was obtained. The average particle diameter of the thus obtained color developed particles C2 was measured using SALD-7000 (manufactured by Shimadzu Corporation) and found to be 2 μm. Further, the complete color erasing temperature Th was 79° C., and the complete color developing temperature Tc was −10° C.

Preparation of Dispersion of Color Developed Particles C3

A solution obtained by heat-dissolving a composition containing 1 part of 3-(2-ethoxy-4-diethylaminophenyl)-3-(1-ethyl-2-methylindol-3-yl)-4-azaphthalide as a leuco dye, 5 parts of 2,2-bis(4-hydroxyphenyl)hexafluoropropane as a color developer, and 50 parts of a diester compound of pimelic acid with 2-(4-benzyloxyphenyl)ethanol as a color eraser, and adding 40 parts of ethyl acetate thereto was added to 250 parts of an aqueous solution of 8% polyvinyl alcohol and emulsified and dispersed therein, and the resulting mixture was kept stirring at 90° C. for about 5 hours, whereby colorless unencapsulated particles were obtained. Further, the thus obtained dispersion of the unencapsulated particles was placed in a freezer to develop a color, whereby a dispersion of blue color developed particles C3 was obtained. The average particle diameter of the thus obtained color developed particles C3 was measured using SALD-7000 (manufactured by Shimadzu Corporation) and found to be 2 μm. Further, the complete color erasing temperature Th was 79° C., and the complete color developing temperature Tc was −10° C.

Preparation of Dispersion of Color Developed Particles C4

A composition containing 1 part of 3,3-bis(p-dimethylaminophenyl)-6-dimethylaminophthalide as a leuco dye, 5 parts of propyl gallate as a color developer, and 50 parts of a polystyrene resin was melt-kneaded, and the resulting kneaded material was pulverized and classified using a jet mill, whereby blue color developed particles were obtained. The obtained color developed particles were added and dispersed in 250 parts of an aqueous solution of 8% polyvinyl alcohol, whereby a dispersion of color developed particles C4 was obtained.

The average particle diameter of the thus obtained color developed particles C4 was measured using SALD-7000 (manufactured by Shimadzu Corporation) and found to be 2.5 μm. When this dispersion of color developed particles was applied to a sheet of paper and heated at 120° C. for 5 hours using a hot plate, the color was erased.

Preparation of Dispersion of Color Developed Particles C5

A composition containing 1 part of 3,3-bis(p-dimethylaminophenyl)-6-dimethylaminophthalide as a leuco dye, 5 parts of ethyl gallate as a color developer, 5 parts of methyl cholate as a color eraser, and 45 parts of a polystyrene resin was melt-kneaded, and the resulting kneaded material was pulverized and classified using a jet mill, whereby blue color developed particles were obtained. The obtained color developed particles were added and dispersed in 250 parts of an aqueous solution of 8% polyvinyl alcohol, whereby a dispersion of color developed particles C5 was obtained.

The average particle diameter of the thus obtained color developed particles C5 was measured using SALD-7000 (manufactured by Shimadzu Corporation) and found to be 3.2 μm. When this dispersion of color developed particles was applied to a sheet of paper and heated at 120° C. for 4 hours using a hot plate, the color was erased.

Preparation of Dispersion of Toner Component Particles Containing Binder Resin

Preparation of Dispersion of Toner Component Particles R1 (Mechanical Emulsification Method by Mechanical Shearing)

94 parts of a polyester resin (glass transition temperature: 45° C., softening point: 100° C.) as a binder resin, 5 parts of rice wax as a release agent, and 1 part of TN-105 (manufactured by Hodogaya Chemical Co., Ltd.) as a charge control agent were uniformly mixed using a dry mixer, and the resulting mixture was melt-kneaded at 80° C. using PCM-45 (manufactured by Ikegai Iron Works Ltd.) which is a twin-screw kneader. The resulting toner composition was pulverized to 2 mm mesh pass using a pin mill, and further pulverized to an average particle diameter of 50 μm using a Bantam mill.

Subsequently, 0.9 parts of sodium dodecylbenzene sulfonate as a surfactant, 0.45 parts of dimethyl aminoethanol as a pH adjusting agent, and 68.65 parts of ion exchanged water were mixed to obtain an aqueous solution, and 30 parts of the pulverized toner composition was dispersed in the aqueous solution, followed by vacuum defoaming, whereby a dispersion liquid was obtained.

Subsequently, the dispersion liquid was subjected to a pulverization treatment at 180° C. and 150 MPa using NANO 3000 (manufactured by Beryu Co., Ltd.) provided with a high-pressure pipe for heat exchange having a length of 12 m immersed in an oil bath as a heating unit, a high-pressure pipe having nozzles having diameters of 0.13 μm and 0.28 μm, respectively, arranged in a row therein as a pressure applying unit, a medium-pressure pipe having cells having pore diameters of 0.4, 1.0, 0.75, 1.5, and 1.0 μm, respectively, arranged in a row therein as a pressure reducing unit, and a heat exchange pipe having a length of 12 m capable of cooling with tap water as a cooling unit. After the pressure was reduced while maintaining the temperature at 180° C., the dispersion liquid was cooled to 30° C., whereby a dispersion of toner component particles R1 was obtained. The average particle diameter of the thus obtained toner component particles R1 was measured using SALD-7000 (manufactured by Shimadzu Corporation) and found to be 0.5 μm.

Preparation of Dispersion of Toner Component Particles R2 (Emulsion Polymerization Method)

A polymerizable monomer component obtained by mixing 35 parts of styrene, 3 parts of butyl acrylate, and 0.5 parts of acrylic acid as polymerizable monomers, and 2 parts of dodecanethiol and 0.5 parts of carbon tetrabromide as chain transfer agents was emulsified using a homogenizer in an aqueous solution obtained by dissolving 0.5 parts of a polyoxyethylene alkyl ether (HLB 16) and 1 part of sodium dodecylbenzene sulfonate in 55.5 parts of ion exchanged water. Then, 2 parts of a 10% ammonium persulfate solution was gradually added thereto, and the resulting mixture was subjected to nitrogen replacement. Then, emulsion polymerization was performed at 70° C. for 5 hours, whereby a dispersion liquid of styrene-acrylic resin particles having an average particle diameter of 0.1 μm, a glass transition temperature of 45° C., and a softening point of 100° C. was obtained.

Subsequently, 30 parts of rice wax, 3 parts of sodium dodecylbenzene sulfonate, and 67 parts of ion exchanged water were mixed and dispersed using a homogenizer (manufactured by IKA Japan K.K.) while heating to 90° C. Then, the resulting dispersion was treated at 180 MPa and 150° C. using a nanomizer (manufactured by Yoshida Kikai Co., Ltd.), whereby a dispersion liquid of release agent particles having a volume average particle diameter of 0.08 μm was prepared.

Subsequently, 70 parts of the dispersion liquid of resin particles, 15 parts of the dispersion liquid of release agent particles, and 15 parts of ion exchanged water were mixed, whereby a dispersion of toner component particles R2 was obtained.

Preparation of Dispersion of Toner Component Particles R3 (Phase Inversion Emulsification Method)

94 parts of a polyester resin (glass transition temperature: 45° C., softening point: 100° C.) as a binder resin, 5 parts of rice wax as a release agent, and 1 part of TN-105 (manufactured by Hodogaya Chemical Co., Ltd.) as a charge control agent were uniformly mixed using a dry mixer, and the resulting mixture was melt-kneaded at 80° C. using PCM-45 (manufactured by Ikegai Iron Works Ltd.) which is a twin-screw kneader. The resulting toner composition was pulverized to 2 mm mesh pass using a pin mill to prepare coarsely pulverized particles.

Subsequently, 100 parts of the thus obtained coarsely pulverized particles, 1.5 parts of sodium dodecylbenzene sulfonate as a surfactant, 1.5 parts of HITENOL EA-177 (HLB 16), 2.1 parts of dimethyl aminoethanol, 2 parts of potassium carbonate, and 70 parts of deionized water were added, the temperature was raised to 115° C. in a 1 L stirring vessel equipped with a max blend blade, and the mixture was stirred at a stirring blade rotation rate of 300 rpm for 2 hours. Thereafter, 160 parts of deionized water was continuously added dropwise thereto over 1 hour at 95° C. Then, the mixture was cooled to room temperature, whereby a dispersion of toner component particles R3 was obtained. The average particle diameter of the thus obtained toner component particles R3 was measured using SALD-7000 (manufactured by Shimadzu Corporation) and found to be 0.1 μm.

Preparation of Dispersion of Shell Forming Particles S (Mechanical Emulsification Method)

100 parts of a polyester resin (glass transition temperature: 58° C., softening point: 125° C.) as a binder resin was pulverized to 2 mm mesh pass using a pin mill, and further pulverized to an average particle diameter of 50 μm using a Bantam mill.

Subsequently, 0.9 parts of sodium dodecylbenzene sulfonate as a surfactant, 0.45 parts of dimethyl aminoethanol as a pH adjusting agent, and 68.65 parts of ion exchanged water were mixed to obtain an aqueous solution, and 30 parts of the thus pulverized polyester resin was dispersed in the aqueous solution, followed by vacuum defoaming, whereby a dispersion liquid was obtained.

Subsequently, the dispersion liquid was subjected to a pulverization treatment at 180° C. and 150 MPa using NANO 3000 (manufactured by Beryu Co., Ltd.) provided with a high-pressure pipe for heat exchange having a length of 12 m immersed in an oil bath as a heating unit, a high-pressure pipe having nozzles having diameters of 0.13 μm and 0.28 μm, respectively, arranged in a row therein as a pressure applying unit, a medium-pressure pipe having cells having pore diameters of 0.4, 1.0, 0.75, 1.5, and 1.0 μm, respectively, arranged in a row therein as a pressure reducing unit, and a heat exchange pipe having a length of 12 m capable of cooling with tap water as a cooling unit. After the pressure was reduced while maintaining the temperature at 180° C., the dispersion liquid was cooled to 30° C., whereby a dispersion of shell forming particles S was obtained. The average particle diameter of the thus obtained shell forming particles S was measured using SALD-7000 (manufactured by Shimadzu Corporation) and found to be 0.1

Example 1

1.7 parts of the dispersion of color developed particles C1, 15 parts of the dispersion of toner component particles R1, and 83 parts of ion exchanged water were mixed, and 5 parts of an aqueous solution of 5% aluminum sulfate was added to the resulting mixture while stirring the mixture at 6500 rpm using a homogenizer (IKA Japan K.K.). Then, the temperature was raised to 40° C. while stirring the mixture at 800 rpm in a 1 L stirring vessel equipped with a paddle blade. After the mixture was left as such at 40° C. for 1 hour, 10 parts of an aqueous solution of 10% sodium polycarboxylate was added thereto, and the resulting mixture was heated to 68° C. and left as such for 1 hour. Then, the mixture was cooled, whereby a colorless toner dispersion liquid was obtained.

Subsequently, this toner dispersion liquid was washed by repeating a procedure including filtration and washing with ion exchanged water until the electrical conductivity of the filtrate became 50 μS/cm. Thereafter, the washed toner was frozen in a freezer at −20° C. to allow the toner to develop a blue color, and then dried using a vacuum dryer until the water content of the toner became 1.0% by weight or less, whereby dried particles were obtained.

After drying, as additives, 2 parts by weight of hydrophobic silica and 0.5 parts by weight of titanium oxide were adhered to the surfaces of the toner particles, whereby a color erasable toner was obtained. The particle diameter of the thus obtained toner was measured using Multisizer 3 (manufactured by Beckman Coulter, Inc.) and it was found that the 50% volume average particle diameter Dv was 10.5 μm.

The thus obtained toner was mixed with a ferrite carrier coated with a silicone resin, an image was output using a copier MFP (e-studio 4520c) manufactured by Toshiba Tec Corporation. The toner is stored in the developing device 14E in the color copier machine 1 and the image forming is performed using only developing device 14E. The temperature of the fixing device was set to 70° C., the paper feed rate was set to 30 mm/sec, and a color undeveloped image was obtained.

It was confirmed that when this color undeveloped image was stored in a freezer at −20° C., the color was developed such that the image had an image density of 0.5.

Example 2

1.7 parts of the dispersion of color developed particles C2, 15 parts of the dispersion of toner component particles R1, and 83 parts of ion exchanged water were mixed, and 5 parts of an aqueous solution of 5% aluminum sulfate was added to the resulting mixture while stirring the mixture at 6500 rpm using a homogenizer (IKA Japan K.K.). Then, the temperature was raised to 40° C. while stirring the mixture at 800 rpm in a 1 L stirring vessel equipped with a paddle blade. After the mixture was left as such at 40° C. for 1 hour, 10 parts of an aqueous solution of 10% sodium polycarboxylate was added thereto, and the resulting mixture was heated to 68° C. and left as such for 1 hour. Then, the mixture was cooled, whereby a blue toner dispersion liquid was obtained.

Subsequently, this toner dispersion liquid was washed by repeating a procedure including filtration and washing with ion exchanged water until the electrical conductivity of the filtrate became 50 μS/cm. Thereafter, the washed toner was dried using a vacuum dryer until the water content of the toner became 1.0% by weight or less, whereby dried particles were obtained.

After drying, as additives, 2 parts by weight of hydrophobic silica and 0.5 parts by weight of titanium oxide were adhered to the surfaces of the toner particles, whereby a color erasable toner was obtained. The particle diameter of the thus obtained toner was measured using Multisizer 3 (manufactured by Beckman Coulter, Inc.) and it was found that the 50% volume average particle diameter Dv was 9.8 μm.

The thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and a color developed image having an image density of 0.5 was obtained.

It was confirmed that by feeding the sheet of paper having the thus obtained color developed image thereon to a fixing device whose temperature was set to 100° C. at a paper feed rate of 100 mm/sec, the image turned into colorless.

It was also confirmed that when the image whose color was erased was stored in a freezer at −20° C., the color of the image was restored to an image density of 0.5 which is equal to that before the color was erased.

Example 3

1.7 parts of the dispersion of color developed particles C2, 15 parts of the dispersion of toner component particles R2, and 83 parts of ion exchanged water were mixed, and 5 parts of an aqueous solution of 5% aluminum sulfate was added to the resulting mixture while stirring the mixture at 6500 rpm using a homogenizer (IKA Japan K.K.). Then, the temperature was raised to 40° C. while stirring the mixture at 800 rpm in a 1 L stirring vessel equipped with a paddle blade. After the mixture was left as such at 40° C. for 1 hour, 10 parts of an aqueous solution of 10% sodium polycarboxylate was added thereto, and the resulting mixture was heated to 90° C. and left as such for 1 hour. Then, the mixture was cooled, whereby a colorless toner dispersion liquid was obtained.

Subsequently, this toner dispersion liquid was washed by repeating a procedure including filtration and washing with ion exchanged water until the electrical conductivity of the filtrate became 50 μS/cm. Thereafter, the washed toner was frozen in a freezer at −20° C. to allow the toner to develop a blue color, and then dried using a vacuum dryer until the water content of the toner became 1.0% by weight or less, whereby dried particles were obtained.

After drying, as additives, 2 parts by weight of hydrophobic silica and 0.5 parts by weight of titanium oxide were adhered to the surfaces of the toner particles, whereby a color erasable toner was obtained. The particle diameter of the thus obtained toner was measured using Multisizer 3 (manufactured by Beckman Coulter, Inc.) and it was found that the 50% volume average particle diameter Dv was 7.5 μm.

The thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and a color developed image having an image density of 0.5 was obtained.

It was confirmed that by feeding the sheet of paper having the thus obtained color developed image thereon to a fixing device whose temperature was set to 100° C. at a paper feed rate of 100 mm/sec, the image turned into colorless.

It was also confirmed that when the image whose color was erased was stored in a freezer at −20° C., the color of the image was restored to an image density of 0.5 which is equal to that before the color was erased.

Example 4

1.7 parts of the dispersion of color developed particles C2, 15 parts of the dispersion of toner component particles R3, and 83 parts of ion exchanged water were mixed, and 5 parts of an aqueous solution of 5% aluminum sulfate was added to the resulting mixture while stirring the mixture at 6500 rpm using a homogenizer (IKA Japan K.K.). Then, the temperature was raised to 40° C. while stirring the mixture at 800 rpm in a 1 L stirring vessel equipped with a paddle blade. After the mixture was left as such at 40° C. for 1 hour, 10 parts of an aqueous solution of 10% sodium polycarboxylate was added thereto, and the resulting mixture was heated to 68° C. and left as such for 1 hour. Then, the mixture was cooled, whereby a blue toner dispersion liquid was obtained.

Subsequently, this toner dispersion liquid was washed by repeating a procedure including filtration and washing with ion exchanged water until the electrical conductivity of the filtrate became 50 μS/cm. Thereafter, the washed toner was dried using a vacuum dryer until the water content of the toner became 1.0% by weight or less, whereby dried particles were obtained.

After drying, as additives, 2 parts by weight of hydrophobic silica and 0.5 parts by weight of titanium oxide were adhered to the surfaces of the toner particles, whereby a color erasable toner was obtained. The particle diameter of the thus obtained toner was measured using Multisizer 3 (manufactured by Beckman Coulter, Inc.) and it was found that the 50% volume average particle diameter Dv was 8.2 μm.

The thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and a color developed image having an image density of 0.5 was obtained.

It was confirmed that by feeding the sheet of paper having the thus obtained color developed image thereon to a fixing device whose temperature was set to 100° C. at a paper feed rate of 100 mm/sec, the image turned into colorless.

It was also confirmed that when the image whose color was erased was stored in a freezer at −20° C., the color of the image was restored to an image density of 0.5 which is equal to that before the color was erased.

Example 5

1.7 parts of the dispersion of color developed particles C3, 15 parts of the dispersion of toner component particles R1, and 83 parts of ion exchanged water were mixed, and 5 parts of an aqueous solution of 5% aluminum sulfate was added to the resulting mixture while stirring the mixture at 6500 rpm using a homogenizer (IKA Japan K.K.). Then, the temperature was raised to 40° C. while stirring the mixture at 800 rpm in a 1 L stirring vessel equipped with a paddle blade. After the mixture was left as such at 40° C. for 1 hour, 10 parts of an aqueous solution of 10% sodium polycarboxylate was added thereto, and the resulting mixture was heated to 68° C. and left as such for 1 hour. Then, the mixture was cooled, whereby a blue toner dispersion liquid was obtained.

Subsequently, this toner dispersion liquid was washed by repeating a procedure including filtration and washing with ion exchanged water until the electrical conductivity of the filtrate became 50 μS/cm. Thereafter, the washed toner was dried using a vacuum dryer until the water content of the toner became 1.0% by weight or less, whereby dried particles were obtained.

After drying, as additives, 2 parts by weight of hydrophobic silica and 0.5 parts by weight of titanium oxide were adhered to the surfaces of the toner particles, whereby a color erasable toner was obtained. The particle diameter of the thus obtained toner was measured using Multisizer 3 (manufactured by Beckman Coulter, Inc.) and it was found that the 50% volume average particle diameter Dv was 9.5 μm.

The thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and a color developed image having an image density of 0.4 was obtained.

It was confirmed that by feeding the sheet of paper having the thus obtained color developed image thereon to a fixing device whose temperature was set to 100° C. at a paper feed rate of 100 mm/sec, the image turned into colorless.

When the image whose color was erased was stored in a freezer at −20° C., the color erased state was maintained and the color was not restored.

Example 6

1.7 parts of the dispersion of color developed particles C4, 15 parts of the dispersion of toner component particles R1, and 83 parts of ion exchanged water were mixed, and 5 parts of an aqueous solution of 5% aluminum sulfate was added to the resulting mixture while stirring the mixture at 6500 rpm using a homogenizer (IKA Japan K.K.). Then, the temperature was raised to 40° C. while stirring the mixture at 800 rpm in a 1 L stirring vessel equipped with a paddle blade. After the mixture was left as such at 40° C. for 1 hour, 10 parts of an aqueous solution of 10% sodium polycarboxylate was added thereto, and the resulting mixture was heated to 68° C. and left as such for 1 hour. Then, the mixture was cooled, whereby a blue toner dispersion liquid was obtained.

Subsequently, this toner dispersion liquid was washed by repeating a procedure including filtration and washing with ion exchanged water until the electrical conductivity of the filtrate became 50 μS/cm. Thereafter, the washed toner was dried using a vacuum dryer until the water content of the toner became 1.0% by weight or less, whereby dried particles were obtained.

After drying, as additives, 2 parts by weight of hydrophobic silica and 0.5 parts by weight of titanium oxide were adhered to the surfaces of the toner particles, whereby a color erasable toner was obtained. The particle diameter of the thus obtained toner was measured using Multisizer 3 (manufactured by Beckman Coulter, Inc.) and it was found that the 50% volume average particle diameter Dv was 10.1 μm.

The thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and a color developed image having an image density of 0.5 was obtained.

It was confirmed that when the color developed image was heated to 120° C. for 3 hours using a hot plate, the image turned into colorless.

When the image whose color was erased was stored in a freezer at −20° C., the color erased state was maintained and the color was not restored.

Example 7

1.7 parts of the dispersion of color developed particles C5, 15 parts of the dispersion of toner component particles R1, and 83 parts of ion exchanged water were mixed, and 5 parts of an aqueous solution of 5% aluminum sulfate was added to the resulting mixture while stirring the mixture at 6500 rpm using a homogenizer (IKA Japan K.K.). Then, the temperature was raised to 40° C. while stirring the mixture at 800 rpm in a 1 L stirring vessel equipped with a paddle blade. After the mixture was left as such at 40° C. for 1 hour, 10 parts of an aqueous solution of 10% sodium polycarboxylate was added thereto, and the resulting mixture was heated to 68° C. and left as such for 1 hour. Then, the mixture was cooled, whereby a blue toner dispersion liquid was obtained.

Subsequently, this toner dispersion liquid was washed by repeating a procedure including filtration and washing with ion exchanged water until the electrical conductivity of the filtrate became 50 μS/cm. Thereafter, the washed toner was dried using a vacuum dryer until the water content of the toner became 1.0% by weight or less, whereby dried particles were obtained.

After drying, as additives, 2 parts by weight of hydrophobic silica and 0.5 parts by weight of titanium oxide were adhered to the surfaces of the toner particles, whereby a color erasable toner was obtained. The particle diameter of the thus obtained toner was measured using Multisizer 3 (manufactured by Beckman Coulter, Inc.) and it was found that the 50% volume average particle diameter Dv was 7.5 μm.

The thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and a color developed image having an image density of 0.5 was obtained.

It was confirmed that when the color developed image was heated to 120° C. for 2 hours using a hot plate, the image turned into colorless.

When the image whose color was erased was stored in a freezer at −20° C., the color erased state was maintained and the color was not restored.

Example 8

1.7 parts of the dispersion of color developed particles C2, 15 parts of the dispersion of toner component particles R1, and 83 parts of ion exchanged water were mixed, and 5 parts of an aqueous solution of 5% aluminum sulfate was added to the resulting mixture while stirring the mixture at 6500 rpm using a homogenizer (IKA Japan K.K.). Then, the temperature was raised to 40° C. while stirring the mixture at 800 rpm in a 1 L stirring vessel equipped with a paddle blade. After the mixture was left as such at 40° C. for 1 hour, 3 parts of the dispersion of shell forming particles S was added thereto, and then, 1 part of an aqueous solution of 0.5% aluminum sulfate was added thereto. Thereafter, 10 parts of an aqueous solution of 10% sodium polycarboxylate was added thereto, and the resulting mixture was heated to 68° C. and left as such for 1 hour. Then, the mixture was cooled, whereby a blue toner dispersion liquid was obtained.

Subsequently, this toner dispersion liquid was washed by repeating a procedure including filtration and washing with ion exchanged water until the electrical conductivity of the filtrate became 50 μS/cm. Thereafter, the washed toner was dried using a vacuum dryer until the water content of the toner became 1.0% by weight or less, whereby dried particles were obtained.

After drying, as additives, 2 parts by weight of hydrophobic silica and 0.5 parts by weight of titanium oxide were adhered to the surfaces of the toner particles, whereby a color erasable toner was obtained. The particle diameter of the thus obtained toner was measured using Multisizer 3 (manufactured by Beckman Coulter, Inc.) and it was found that the 50% volume average particle diameter Dv was 11.1 μm.

The thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and a color developed image having an image density of 0.5 was obtained.

It was confirmed that by feeding the sheet of paper having the thus obtained color developed image thereon to a fixing device whose temperature was set to 100° C. at a paper feed rate of 100 mm/sec, the image turned into colorless.

It was also confirmed that when the image whose color was erased was restored in a freezer at −20° C., the color of the image was restored to an image density of 0.5 which is equal to that before the color was erased.

Comparative Example 1

84 parts of a polyester resin (glass transition temperature: 45° C., softening point: 100° C.) as a binder resin, 5 parts of rice wax as a release agent, 1 part of TN-105 (manufactured by Hodogaya Chemical Co., Ltd.) as a charge control agent, 0.3 parts of 3-(4-diethylamino-2-hexyloxyphenyl)-3-(1-ethyl-2-methylindol-3-yl)-4-azaphthalide as a leuco dye, 0.6 parts of 11E is (4'-hydroxyphenyl)hexafluoropropane and 0.6 parts of 11E is (4'-hydroxyphenyl)n-decane as color developers, and 8.5 parts of 4-benzyloxyphenylethyl caprylate as a color eraser were uniformly mixed using a dry mixer, and the resulting mixture was melt-kneaded at 100° C. using PCM-45 (manufactured by Ikegai Iron Works Ltd.) which is a twin-screw kneader, whereby an almost colorless kneaded material was obtained. The thus obtained kneaded material was pulverized to 2 mm mesh pass using a pin mill.

Subsequently, the pulverized material was further pulverized and classified using a jet mill, and as additives, 2 parts by weight of hydrophobic silica and 0.5 parts by weight of titanium oxide were adhered to the surfaces of the toner particles, whereby a colorless toner was obtained. The particle diameter of the thus obtained toner was measured using Multisizer 3 (manufactured by Beckman Coulter, Inc.) and it was found that the 50% volume average particle diameter Dv was 8.5 μm.

The thus obtained toner was stored in a freezer at −20° C., however, the toner remained colorless, and the color was not developed.

Further, the thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and a colorless image was obtained.

The colorless image was stored in a freezer at −20° C., however, the image remained colorless and the color was not developed.

Comparative Example 2

84 parts of a polyester resin (glass transition temperature: 45° C., softening point: 100° C.) as a binder resin, 5 parts of rice wax as a release agent, 1 part of TN-105 (manufactured by Hodogaya Chemical Co., Ltd.) as a charge control agent, 0.2 parts of 3-(2-ethoxy-4-diethylaminophenyl)-3-(1-ethyl-2-methylindol-3-yl)-4-azaphthalide as a leuco dye, 1 part of 2,2-bis(4-hydroxyphenyl)hexafluoropropane as a color developer, and 8.8 parts of a diester compound of pimelic acid with 2-(4-benzyloxyphenyl)ethanol as a color eraser were uniformly mixed using a dry mixer, and the resulting mixture was melt-kneaded at 100° C. using PCM-45 (manufactured by Ikegai Iron Works Ltd.) which is a twin-screw kneader, whereby an almost colorless kneaded material was obtained. The thus obtained kneaded material was pulverized to 2 mm mesh pass using a pin mill.

Subsequently, the pulverized material was further pulverized and classified using a jet mill, and as additives, 2 parts by weight of hydrophobic silica and 0.5 parts by weight of titanium oxide were adhered to the surfaces of the toner particles, whereby a colorless toner was obtained. The particle diameter of the thus obtained toner was measured using Multisizer 3 (manufactured by Beckman Coulter, Inc.) and it was found that the 50% volume average particle diameter Dv was 8.5 μm.

The thus obtained toner was stored in a freezer at −20° C., however, the toner remained colorless, and the color was not developed.

Further, the thus obtained toner was mixed with a ferrite carrier coated with a silicone resin, and an image was output using MFP (e-studio 4520c) manufactured by Toshiba Tec Corporation in the same way as example 1. The temperature of the fixing devie was set to 70° C., the paper feed rate was set to 30 mm/sec, and a colorless image was obtained.

The colorless image was stored in a freezer at −20° C., however, the image remained colorless and the color was not developed.

Comparative Example 3

93 parts of a polyester resin (glass transition temperature: 45° C., softening point: 100° C.) as a binder resin, 5 parts of rice wax as a release agent, 1 part of TN-105 (manufactured by Hodogaya Chemical Co., Ltd.) as a charge control agent, 0.3 parts of 3,3-bis(p-dimethylaminophenyl)-6-dimethylaminophthalide as a leuco dye, and 0.7 parts of propyl gallate as a color developer were uniformly mixed using a dry mixer, and the resulting mixture was melt-kneaded at 100° C. using PCM-45 (manufactured by Ikegai Iron Works Ltd.) which is a twin-screw kneader, whereby an almost colorless kneaded material was obtained. The thus obtained kneaded material was pulverized to 2 mm mesh pass using a pin mill.

Subsequently, the pulverized material was further pulverized and classified using a jet mill, and as additives, 2 parts by weight of hydrophobic silica and 0.5 parts by weight of titanium oxide were adhered to the surfaces of the toner particles, whereby a colorless toner was obtained. The particle diameter of the thus obtained toner was measured using Multisizer 3 (manufactured by Beckman Coulter, Inc.) and it was found that the 50% volume average particle diameter Dv was 7.8 μm.

The thus obtained toner was stored in a freezer at −20° C., however, the toner remained colorless, and the color was not developed.

Further, the thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and a colorless image was obtained.

The colorless image was stored in a freezer at −20° C., however, the image remained colorless and the color was not developed.

Comparative Example 4

92 parts of a polyester resin (glass transition temperature: 45° C., softening point: 100° C.) as a binder resin, 5 parts of rice wax as a release agent, 1 part of TN-105 (manufactured by Hodogaya Chemical Co., Ltd.) as a charge control agent, 0.3 parts of 3,3-bis(p-dimethylaminophenyl)-6-dimethylaminophthalide as a leuco dye, 0.6 parts of ethyl gallate as a color developer, and 1.1 parts of methyl cholate as a color eraser were uniformly mixed using a dry mixer, and the resulting mixture was melt-kneaded at 100° C. using PCM-45 (manufactured by Ikegai Iron Works Ltd.) which is a twin-screw kneader, whereby an almost colorless kneaded material was obtained. The thus obtained kneaded material was pulverized to 2 mm mesh pass using a pin mill.

Subsequently, the pulverized material was further pulverized and classified using a jet mill, and as additives, 2 parts by weight of hydrophobic silica and 0.5 parts by weight of titanium oxide were adhered to the surfaces of the toner particles, whereby a colorless toner was obtained. The particle diameter of the thus obtained toner was measured using Multisizer 3 (manufactured by Beckman Coulter, Inc.) and it was found that the 50% volume average particle diameter Dv was 7.9 μm.

The thus obtained toner was stored in a freezer at −20° C., however, the toner remained colorless, and the color was not developed.

Further, the thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and a colorless image was obtained.

The colorless image was stored in a freezer at −20° C., however, the image remained colorless and the color was not developed.

Comparative Example 5

85 parts of a polyester resin (glass transition temperature: 45° C., softening point: 100° C.) as a binder resin, 5 parts of rice wax as a release agent, 1 part of TN-105 (manufactured by Hodogaya Chemical Co., Ltd.) as a charge control agent, and 10 parts of the color developed particles C1 were uniformly mixed using a dry mixer, and the resulting mixture was melt-kneaded at 100° C. using PCM-45 (manufactured by Ikegai Iron Works Ltd.) which is a twin-screw kneader, whereby an almost colorless kneaded material was obtained. The thus obtained kneaded material was pulverized to 2 mm mesh pass using a pin mill.

Subsequently, the pulverized material was further pulverized and classified using a jet mill, and as additives, 2 parts by weight of hydrophobic silica and 0.5 parts by weight of titanium oxide were adhered to the surfaces of the toner particles, whereby a colorless toner was obtained. The particle diameter of the thus obtained toner was measured using Multisizer 3 (manufactured by Beckman Coulter, Inc.) and it was found that the 50% volume average particle diameter Dv was 8.2 μm.

When the thus obtained toner was stored in a freezer at −20° C., the color of the toner was slightly developed.

Further, the thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and a colorless image was obtained.

When the colorless image was stored in a freezer at −20° C., the color of the image was slightly developed and the image density was 0.1.

Comparative Example 6

85 parts of a polyester resin (glass transition temperature: 45° C., softening point: 100° C.) as a binder resin, 5 parts of rice wax as a release agent, 1 part of TN-105 (manufactured by Hodogaya Chemical Co., Ltd.) as a charge control agent, and 10 parts of the color developed particles C2 were uniformly mixed using a dry mixer, and the resulting mixture was melt-kneaded at 100° C. using PCM-45 (manufactured by Ikegai Iron Works Ltd.) which is a twin-screw kneader, whereby an almost colorless kneaded material was obtained. The thus obtained kneaded material was pulverized to 2 mm mesh pass using a pin mill.

Subsequently, the pulverized material was further pulverized and classified using a jet mill, and as additives, 2 parts by weight of hydrophobic silica and 0.5 parts by weight of titanium oxide were adhered to the surfaces of the toner particles, whereby a colorless toner was obtained. The particle diameter of the thus obtained toner was measured using Multisizer 3 (manufactured by Beckman Coulter, Inc.) and it was found that the 50% volume average particle diameter Dv was 8.5 μm.

When the thus obtained toner was stored in a freezer at −20° C., the color of the toner was slightly developed.

Further, the thus obtained toner was mixed with a ferrite carrier coated with a silicone resin, and an image was output using MFP (e-studio 4520c) manufactured by Toshiba Tec Corporation in the same way as example 1. The temperature of the fixing device was set to 70° C., the paper feed rate was set to 30 mm/sec, and an image whose color was slightly developed with an image density of 0.15 was obtained.

It was confirmed that by feeding the sheet of paper having the thus obtained color developed image thereon to a fixing device whose temperature was set to 100° C. at a paper feed rate of 100 mm/sec, the image turned into colorless.

When the colorless image was stored in a freezer at −20° C., the color of the image was slightly developed and the image density was 0.15.

The toners of Examples 1 to 8 are excellent in color developability because the production method does not employ melt-kneading and therefore the reaction between the leuco dye and the color developer is not inhibited in the binder resin. Further, since a polyester resin or a styrene-acrylic resin can be used, the toners of Examples 1 to 8 are excellent in fixability.

With regard to the aspect of color erasability, although it is possible to erase the color of any toner, particularly the toners of Examples 1 to 3 are excellent in the point that when a certain amount of heat is applied to the minute capsules even if the entire toner is not melted by heating, the dye, the color developer, and the color eraser are considered to move in the capsules, and therefore, an energy and time required for erasing the color can be reduced.

The color developed particles used in Examples and Comparative Examples are summarized in Table 1, the toner component particles and shell forming particles S are summarized in Table 2.

The configuration, evaluation, and the like for the toners of Examples and Comparative Examples are shown in Tables 3.

TABLE 1

| | Leuco dye | Color coupler | Color eraser | Encapsulation | Complete color erasing temperature (° C.) | Complete color developing temperature (° C.) | Particle diameter (μm) |
|---|---|---|---|---|---|---|---|
| Color developed particles C1 | 3-(4-diethylamino-2-hexyloxyphenyl)-3-(1-ethyl-2-methylindol-3-yl)-4-azaphthalide | 1,1-bis(4'-hydroxyphenyl)hexa fluoropropane and 1,1-bis(4'-hydroxyphenyl)n-decane | 4-benzyloxyphenylethyl caprylate | Encapsulated | 62 | −14 | 3 |
| Color developed particles C2 | 3-(2-ethoxy-4-diethylaminophenyl)-3-(1-ethyl-2-methylindol-3-yl)-4-azaphthalide | 2,2-bis(4-hydroxyphenyl)hexa fluoropropane | a diester compound of pimelic acid with 2-(4-benzyloxyphenyl)ethanol | Encapsulated | 79 | −10 | 2 |
| Color developed particles C3 | 3-(2-ethoxy-4-diethylaminophenyl)-3-(1-ethyl-2-methylindol-3-yl)-4-azaphthalide | 2,2-bis(4-hydroxyphenyl)hexa fluoropropane | a diester compound of pimelic acid with 2-(4-benzyloxyphenyl)ethanol | Unencapsulated | 79 | −10 | 2 |
| Color developed particles C4 | 3,3-bis(p-dimethylaminophenyl)-6-dimethylaminophthalide | propyl gallate | Non (as a binder, a polystyrene resin) | Unencapsulated | 120 | Non | 2.5 |
| Color developed particles C5 | 3,3-bis(p-dimethylaminophenyl)-6-dimethylaminophthalide | ethyl gallate | methyl cholate (as a binder, a polystyrene resin) | Unencapsulated | 120 | Non | 3.2 |

TABLE 2

| | Production method | Component | Tg (° C.) | Softening point (° C.) | Particle diameter (μm) |
|---|---|---|---|---|---|
| Toner component particles R1 | Mechanical emulsification method | polyester resin + rice wax | 45 | 100 | 0.5 |
| Toner component particles R2 | Emulsion polymerization method | styrene acrylic resin + rice wax | 45 | 100 | 0.1 + 0.08 |
| Toner component particles R3 | Phase inversion emulsification method | polyester resin + rice wax | 45 | 100 | 0.1 |
| Shell forming particles S | Mechanical emulsification method | polyester resin | 58 | 125 | 0.1 |

TABLE 3

| | | Toner configuration | | |
|---|---|---|---|---|
| | Production method | Color developed particles | Toner component particles | Shell forming particles |
| Example 1 | Aggregation method | C1 | R1 | Non |
| Example 2 | Aggregation method | C2 | R1 | Non |
| Example 3 | Aggregation method | C2 | R2 | Non |
| Example 4 | Aggregation method | C2 | R3 | Non |
| Example 5 | Aggregation method | C3 | R1 | Non |
| Example 6 | Aggregation method | C4 | R1 | Non |
| Example 7 | Aggregation method | C5 | R1 | Non |
| Example 8 | Aggregation method | C2 | R1 | S |
| Comparative Example 1 | Kneading pulverization method | C1 formulation (unencapsulated) + polyester resin + rice wax | | |
| Comparative Example 2 | Kneading pulverization method | C2 formulation (unencapsulated) + polyester resin + rice wax | | |
| Comparative Example 3 | Kneading pulverization method | C4 formulation + polyester resin + rice wax | | |
| Comparative Example 4 | Kneading pulverization method | C5 formulation + polyester resin + rice wax | | |
| Comparative Example 5 | Kneading pulverization method | C1 + polyester resin + rice wax | | |
| Comparative Example 6 | Kneading pulverization method | C2 + polyester resin + rice wax | | |

TABLE 3-continued

| | Toner particle diameter (μm) | Color developed or erased state of toner or image | | | | | |
|---|---|---|---|---|---|---|---|
| | | After forming toner | After freezing toner | After fixing step *1 | After color erasing step *2 | After freezing color erased image | Image density when color was developed |
| Example 1 | 10.5 | erased | developed | erased | not evaluated | developed | 0.5 |
| Example 2 | 9.8 | developed | — | developed | erased | developed | 0.5 |
| Example 3 | 7.5 | erased | developed | developed | erased | developed | 0.5 |
| Example 4 | 8.2 | developed | — | developed | erased | developed | 0.5 |
| Example 5 | 9.5 | developed | — | developed | erased | not developed | 0.4 |
| Example 6 | 10.1 | developed | — | developed | erased by heating for 3 h *3 | not developed | 0.5 |
| Example 7 | 7.5 | developed | — | developed | erased by heating for 2 h *3 | not developed | 0.4 |
| Example 8 | 11.1 | developed | — | developed | erased | developed | 0.5 |
| Comparative Example 1 | 8.5 | erased | not developed | erased | not evaluated | not developed | not evaluated |
| Comparative Example 2 | 8.1 | erased | not developed | erased | not evaluated | not developed | not evaluated |
| Comparative Example 3 | 7.8 | erased | not developed | erased | not evaluated | not developed | not evaluated |
| Comparative Example 4 | 7.9 | erased | not developed | erased | not evaluated | not developed | not evaluated |
| Comparative Example 5 | 8.2 | erased | slightly developed | erased | not evaluated | slightly developed | 0.1 |
| Comparative Example 6 | 8.5 | erased | slightly developed | slightly developed | erased | slightly developed | 0.15 |

In Table 3, *1 indicates that the temperature of the fixing device was set to 70° C. and the paper feed rate was set to 30 mm/sec;
*2 indicates that the temperature of the fixing device was set to 100° C. and the paper feed rate was set to 100 mm/sec; and
*3 indicates that a hot plate at 120° C. was used because the color erasing rate was low.

The Yellow, Magetna, Cyan toners are explained.

The following materials were prepared as materials for yellow, magenta and cyan developed particles and each color toner were produced by the same method as the toner production method in Example 1.

Production of Color Developed Particles for Yellow

Hereinafter, "part" represents "part by weight" and "%" represents "% by weight".

A solution obtained by uniformly heat-dissolving a composition containing 3.0 parts of 4-[2,6-bis(2-ethoxyphenyl)-4-pyridinyl]-N,N-dimethylbenzenamine, 10.0 parts of 2,2-bis(4'-hydroxyphenyl)hexafluoropropane, and 50 parts of a diester compound of pimelic acid with 2-(4-benzyloxyphenyl)ethanol as a color eraser, and adding 20 parts of an aromatic polyvalent isocyanate prepolymer and 40 parts of ethyl acetate thereto as encapsulating agents was added to 250 parts of an aqueous solution of 8% polyvinyl alcohol and emulsified and dispersed therein, and the resulting mixture was kept stirring at 90° C. for about 1 hour. Then, as a reaction agent, 2 parts of a water-soluble aliphatic denatured amine was added thereto, and the resulting mixture was further kept stirring for about 3 hours while maintaining the temperature of the mixture at 90° C., whereby colorless encapsulated particles were obtained. Further, the thus obtained dispersion of the encapsulated particles was placed in a freezer to develop a color, whereby a dispersion of yellow color developed particles was obtained. The average particle diameter of the thus obtained yellow color developed particles was measured using SALD-7000 (manufactured by Shimadzu Corporation) and found to be 2 μm. Further, the complete color erasing temperature Th was 79° C., and the complete color developing temperature Tc was −10° C.

Production of Color Developed Particles for Magenta.

A solution obtained by uniformly heat-dissolving a composition containing 1.0 part of 1,2-benz-6-(N-ethyl-N-isoamylamino)fluoran, 2.0 parts of 1,3-dimethyl-6-diethylaminofluoran, 4.5 parts of 4,4'-(2-methylpropylidene) bisphenol, 7.5 parts of 2,2-bis(4'-hydroxyphenyl) hexafluoropropane, and 50 parts of a diester compound of pimelic acid with 2-(4-benzyloxyphenyl)ethanol as a color eraser, and adding 20 parts of an aromatic polyvalent isocyanate prepolymer and 40 parts of ethyl acetate thereto as encapsulating agents was added to 250 parts of an aqueous solution of 8% polyvinyl alcohol and emulsified and dispersed therein, and the resulting mixture was kept stirring at 90° C. for about 1 hour. Then, as a reaction agent, 2 parts of a water-soluble aliphatic denatured amine was added thereto, and the resulting mixture was further kept stirring for about 3 hours while maintaining the temperature of the mixture at 90° C., whereby colorless encapsulated particles were obtained. Further, the thus obtained dispersion of the encapsulated particles was placed in a freezer to develop a color, whereby a dispersion of magenta color developed particles was obtained. The average particle diameter of the thus obtained magenta color developed particles was measured using SALD-7000 (manufactured by Shimadzu Corporation) and found to be 2 μm. Further, the complete color erasing temperature Th was 79° C., and the complete color developing temperature Tc was −10° C.

Production of Color Developed Particles for Cyan.

A solution obtained by uniformly heat-dissolving a composition containing 2.0 parts of 4,5,6,7-tetrachloro-3-[4-(dimethylamino)-2-methylphenyl]-3-(1-ethyl-2-methyl-1H-indol-3-yl)-1(3H)-isobenzofuranone, 3.0 parts of 4,4'-(2-ethylhexane-1,1-diyl)diphenol, 5.0 parts of 2,2-bis(4'-hydroxyphenyl)hexafluoropropane, and 50 parts of a diester compound of pimelic acid with 2-(4-benzyloxyphenyl)ethanol as a color eraser, and adding 20 parts of an aromatic polyvalent isocyanate prepolymer and 40 parts of ethyl acetate thereto as encapsulating agents was added to 250 parts of an aqueous solution of 8% polyvinyl alcohol and emulsified and dispersed therein, and the resulting mixture was kept stirring at 90° C. for about 1 hour. Then, as a reaction agent, 2 parts of a water-soluble aliphatic denatured amine was added thereto, and the resulting mixture was further kept stirring for about 3 hours while maintaining the temperature of the mixture at 90° C., whereby colorless encapsulated particles were obtained. Further, the thus obtained dispersion of the encapsulated particles was placed in a freezer to develop a color, whereby a dispersion of cyan color developed particles was obtained. The average particle diameter of the thus obtained cyan color developed particles was measured using SALD-7000 (manufactured by Shimadzu Corporation) and found to be 2 μm. Further, the complete color erasing temperature Th was 79° C., and the complete color developing temperature Tc was −10° C.

The above-prepared color developed particles of each color were used in place of the dispersion of the color developed particles C2 in Example 2, and a toner of each color was obtained in the same manner as in Example 2.

The yellow toner is stored in the developing device 14Y, magenta toner is stored in the developing device 14M and cyan toner is stored in the developing device 14C in the color copier 1. The color image comprising at least one toner selected from the Y, M, C toners is formed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method for producing a toner comprising:

preparing a dispersion liquid including polymeric particles having a first volume average particle diameter, and color developed particles having a second volume average particle diameter larger than the first volume average particle diameter and containing a color developable compound, a color developer, and a color eraser; and aggregating the polymeric particles and color developed particles in the dispersion liquid to form aggregated particles.

2. The method according to claim 1, wherein the polymeric particles have a volume average particle diameter ranges of from 0.01 to 2.0 μm.

3. The method according to claim 1, wherein the color developed particles have a volume average particle diameter ranges of from 0.05 to 10.0 μm.

4. The method according to claim 1, wherein the color developed particles are encapsulated particles.

5. A toner comprising:

at least one encapsulated particle containing a color developable compound, a color developer and a color eraser; and polymeric particles, the at least one encapsulated particle and the polymeric particles being aggregated and fused in dispersion liquid.

6. The toner according to claim 5, wherein the color developed particles have a volume average particle diameter of encapsulated particle ranges of from 0.05 to 10.0 μm.

7. The toner according to claim 5, wherein the average diameter of the polymeric particle ranges of from 0.01 to 2.0 m.

8. A toner cartridge comprising a cartridge body storing a toner; and the toner according to claim 5 stored in the cartridge body.

9. A process cartridge, comprising:

at least a photosensitive member, and a developing device containing the toner according to claim 5.

10. An image forming apparatus a toner cartridge comprising a cartridge body storing a toner and the toner according to claim 5 stored in the cartridge body.

* * * * *